US009597877B2

(12) United States Patent
Kajimoto et al.

(10) Patent No.: US 9,597,877 B2
(45) Date of Patent: Mar. 21, 2017

(54) INK JET RECORDING APPARATUS

(71) Applicant: Seiko Epson Corporation, Tokyo (JP)

(72) Inventors: Hiroyuki Kajimoto, Osaka (JP); Shoki Kasahara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 14/227,486

(22) Filed: Mar. 27, 2014

(65) Prior Publication Data

US 2014/0292911 A1 Oct. 2, 2014

(30) Foreign Application Priority Data

Mar. 29, 2013 (JP) ..... 2013-072356

(51) Int. Cl.
*B41J 2/165* (2006.01)

(52) U.S. Cl.
CPC ..... *B41J 2/16535* (2013.01); *B41J 2/165* (2013.01); *B41J 2/16505* (2013.01); *B41J 2/16532* (2013.01); *B41J 2/16544* (2013.01)

(58) Field of Classification Search
CPC ..... B41J 2/16552; B41J 2/16588; B41J 2002/16558; B41J 2002/1655; B41J 2/16505; B41J 2/1642; B41J 2/1606; B41J 2/165; B41J 2/16544; B41J 2/16532
USPC ..... 347/29
See application file for complete search history.

(56) References Cited

U.S. PATENT DOCUMENTS 5,867,184 A * 2/1999 Quintana ..... 347/29
6,000,780 A * 12/1999 Schwiebert ..... B41J 2/16547 15/256.5
7,210,763 B2 5/2007 Kato et al
7,267,426 B2 * 9/2007 Miyajima ..... B41J 2/1433 347/45
8,100,504 B2 * 1/2012 Yokohama et al. ..... 347/47
2007/0279450 A1 * 12/2007 Matsuhashi et al. ..... 347/29
2008/0186352 A1 * 8/2008 Sasayama ..... 347/30
2010/0079539 A1 * 4/2010 Inoue ..... B41J 2/16535 347/33
2010/0214355 A1 * 8/2010 Inoue ..... 347/28
2011/0063369 A1 * 3/2011 Okamura ..... B41J 2/14233 347/44
2011/0234693 A1 * 9/2011 Yamaguchi ..... B41J 2/16552 347/28
2012/0050394 A1 3/2012 Takada et al.
(Continued)

FOREIGN PATENT DOCUMENTS

JP 2001-301181 A 10/2001
JP 2002-225255 A 8/2002
(Continued)

*Primary Examiner* — Matthew Luu
*Assistant Examiner* — Patrick King
(74) *Attorney, Agent, or Firm* — Nutter McClennen & Fish LLP; John J. Penny, Jr.; Derek Roller

(57) ABSTRACT

The ink jet recording apparatus comprises a recording head provided with a nozzle forming surface provided with nozzles which discharge an ink composition containing inorganic pigments, and a liquid repelling film which is provided on the nozzle forming surface; a maintenance unit for preserving the recording head; and a movement section which is arranged at a position which faces the nozzle forming surface and the maintenance unit and which relatively moves the nozzle forming surface and the maintenance unit.

19 Claims, 8 Drawing Sheets

(56) References Cited

U.S. PATENT DOCUMENTS

| | | | | |
|---|---|---|---|---|
| 2012/0218346 | A1* | 8/2012 | Inoue | 347/33 |
| 2012/0236071 | A1 | 9/2012 | Inoue | |
| 2014/0085376 | A1 | 3/2014 | Kato et al. | |

FOREIGN PATENT DOCUMENTS

| | | | |
|---|---|---|---|
| JP | 2004-209897 | A | 7/2004 |
| JP | 2007-050590 | A | 3/2007 |
| JP | 2009-233911 | A | 10/2009 |
| JP | 4424954 | B2 | 3/2010 |
| JP | 2012-144035 | A | 8/2012 |
| JP | 2013-031962 | A | 2/2013 |
| WO | 2011/099230 | A1 | 8/2011 |
| WO | 2012/117742 | A1 | 9/2012 |

* cited by examiner

INK JET RECORDING APPARATUS

Priority is claimed under 35 U.S.C. §119 to Japanese Application No. 2013-072356 filed on Mar. 29, 2013, is hereby incorporated by reference in its entirety.

BACKGROUND

1.. Technical Field

The present invention relates to an ink jet recording apparatus.

2. Related Art

In the related art, there are known so-called ink jet recording apparatuses which record images and text using minute droplets of ink which are discharged from nozzles in an ink jet recording head. Various inks are used as the inks which are used in the recording of the images and the like according to such ink jet recording apparatuses, such as aqueous inks where coloring materials (for example, pigments) are dissolved and dispersed in a mixture of an organic solvent and water, and non-aqueous inks where coloring materials are dissolved and dispersed in an organic solvent, and the like.

In a case of using an ink jet recording apparatus, there are times when ink is attached to nozzle forming surfaces where the nozzles are provided. There are times when the ink which is attached to the nozzle forming surfaces is thickened and solidified due to the evaporation of water and other volatile components which are included therein. In addition, there are cases where fiber waste and paper dust which are generated from recording media such as paper or cloth are attached to the nozzle forming surfaces. In this manner, when foreign matter such as ink, paper, fibers, and dust are attached to the nozzles or the vicinity of the nozzles, there are cases where normal discharge of the ink is blocked.

In addition, in recent ink jet recording apparatuses, the diameters of the nozzles which discharge ink are smaller in order to perform high-definition recording, and the energy which is needed in the discharging of the inks is also reduced accordingly. When the nozzle diameters and the energy which is needed in the discharging are reduced, ink discharge failures due to nozzle clogging occur easily and discharge failures due to bubbles which enter ink flow paths or inside the nozzles occur easily.

With respect to the problem of discharge failures, for example, JP-A-2012-144035 discloses a mechanism which moisturizes a nozzle surface of a head after flowing a cleaning liquid between a nozzle surface of a head and a cleaning liquid holding surface which is installed in parallel with the nozzle surface, accumulating the used cleaning liquid in a lower flow section, moving the head to an upper section of a portion where the cleaning liquid remains, and wiping off the nozzle surface with a wiper blade of rubber or the like which is arranged at the portion where the cleaning liquid remains. In addition, JP-A-2004-209897 discloses a mechanism which moisturizes a nozzle surface by cleaning the nozzle surface by filling the inside of a capping member with cleaning liquid in a state where the nozzle surface is capped and filling the inside of the capping member with cleaning liquid again after wiping (wiping off) the nozzle surface.

The mechanisms which wipe off a nozzle forming surface and which are described in JP-A-2012-144035 and JP-A-2004-209897 all use a wiper of rubber or the like. Since it is not possible for such wipers of rubber or the like to absorb foreign matter which is attached to the nozzle forming surface, the foreign matter is pushed inside the nozzles during the wiping off and discharge failure may be generated.

In addition, since the wipers of rubber or the like move while pushing aside the foreign matter which is attached to the nozzle forming surface toward the outside from the central portion of the wipers, it is possible to set the immediate vicinity of the nozzles to a state where foreign matter is not present; however, foreign matter is likely to be deposited at the periphery of the wiper (that is, the end sections of the nozzle forming surface). In a case where the foreign matter is deposited on the nozzle forming surface in this manner, if there is a capping member or the like which moisturizes the nozzle forming surface, capping failure or the like may be generated and cause a discharge failure.

However, in a case where a mechanism which wipes off the nozzle surface with a wiper or the like is used in order to avoid the problems described above, there are cases where there is significant damage to a liquid repelling film due to the pushing pressure of the wiper pressing on the nozzle surface. When the liquid repelling film is damaged in this manner, the discharging of the ink is unstable and there are cases where problems occur such as that the landing positions of the liquid droplets (dots) of the ink are shifted.

SUMMARY

An advantage of some aspects of the invention is that an ink jet recording apparatus is provided where the cleaning property of a nozzle forming surface is excellent and the discharge stability of the ink is excellent.

APPLICATION EXAMPLE 1

According to an aspect of the invention, there is provided an ink jet recording apparatus which has a recording head provided with a nozzle forming surface provided with nozzles which discharge an ink composition containing inorganic pigments, and a liquid repelling film which is provided on the nozzle forming surface; a maintenance unit for preserving the recording head; and a movement section which is arranged at a position which faces the nozzle forming surface and the maintenance unit and which relatively moves the nozzle forming surface and the maintenance unit, where the maintenance unit has a wiping unit which has a cleaning liquid applying unit which applies a cleaning liquid to the nozzle forming surface, an absorbing member which absorbs attachments which are attached to the nozzle forming surface, a pressing mechanism which presses the absorbing member and the recording head with a load of 8 gf/cm or more to 150 gf/cm or less, and a driving mechanism which wipes off attachments on the nozzle forming surface by relatively moving the absorbing member with respect to the nozzle forming surface.

According to the ink jet recording apparatus of Application Example 1, the cleaning property of the nozzle forming surface is excellent and the discharge stability of the ink is excellent.

APPLICATION EXAMPLE 2

In Application Example 1, the cleaning liquid applying unit may have a cleaning liquid supply port which supplies the cleaning liquid to the nozzle forming surface, and the cleaning liquid may form a liquid film on the nozzle forming surface.

APPLICATION EXAMPLE 3

In Application Example 1 or Application Example 2, the maintenance unit may further have a first capping section which covers the nozzle forming surface and which is provided with a suction mechanism which suctions the ink composition which is present on the nozzles.

APPLICATION EXAMPLE 4

In Application Example 3, the maintenance unit may further have a second capping section which forms a closed space by coming into contact with the nozzle forming surface.

APPLICATION EXAMPLE 5

In Application Example 4, a control unit which controls the maintenance unit is further provided, where the control unit may perform, in the following order, a cleaning liquid applying operation to apply the cleaning liquid to the nozzle forming surface, a wiping off operation to wipe off attachments on the nozzle forming surface with the absorbing member while pressing the absorbing member to the nozzle forming surface, and a moisturizing operation to moisturize the nozzle forming surface with the second capping section.

APPLICATION EXAMPLE 6

In Application Example 4 or Application Example 5, the cleaning liquid applying unit, the absorbing member, and the second capping section may be arranged to be lined up in order along the relative moving direction according to the movement section.

APPLICATION EXAMPLE 7

In Application Example 4 or Application Example 5, the cleaning liquid applying unit and the second capping section may be arranged to be lined up along the relative moving direction according to the movement section.

APPLICATION EXAMPLE 8

In Application Example 7, the nozzle forming surface, the cleaning liquid applying unit, and the second capping section may be provided to be inclined with respect to a horizontal plane.

APPLICATION EXAMPLE 9

In Application Example 8, the cleaning liquid supply port may be arranged at a position which is higher than the second capping section.

APPLICATION EXAMPLE 10

In Application Example 3, the absorbing member and the first capping section may be arranged to be lined up along the relative moving direction according to the movement section.

APPLICATION EXAMPLE 11

In one example of any of Application Example 1 to Application Example 10, a surface tension of the cleaning liquid may be 20 mN/m or more and 45 mN/m or less.

BRIEF DESCRIPTION OF THE DRAWINGS

The invention will be described with reference to the accompanying drawings, wherein like numbers reference like elements.

DESCRIPTION OF EXEMPLARY EMBODIMENTS

Suitable embodiments of the invention will be described below. The embodiments which are described below are for describing an example of the invention. In addition, the invention is not limited to the following embodiments but includes various types of modified examples implemented without departing from the scope of the invention.

1. Ink Jet Recording Apparatus

The ink jet recording apparatus according to one embodiment of the invention has a recording head provided with a nozzle forming surface provided with nozzles which discharge an ink composition containing inorganic pigments, and a liquid repelling film which is provided on the nozzle forming surface; a maintenance unit for preserving the recording head; and a movement section which is arranged at a position which faces the nozzle forming surface and the maintenance unit and which relatively moves the nozzle forming surface and the maintenance unit, where the maintenance unit has a cleaning liquid applying unit which applies a cleaning liquid to the nozzle forming surface, an absorbing member which absorbs attachments which are attached to the nozzle forming surface, and a wiping unit which has a pressing mechanism which presses the absorbing member and the nozzle forming surface with a load of 8 gf/cm or more to 150 gf/cm or less, and a driving mechanism which wipes off attachments on the nozzle forming surface by relatively moving the absorbing member with respect to the nozzle forming surface.

1.1. Apparatus Configuration

The configuration of the ink jet recording apparatus according to the present embodiment will be described in detail with reference to the drawings. Here, in order to facilitate understanding of the structure of the ink jet recording apparatus according to the present embodiment, there are cases where the scale is appropriately changed.

Figure 1:
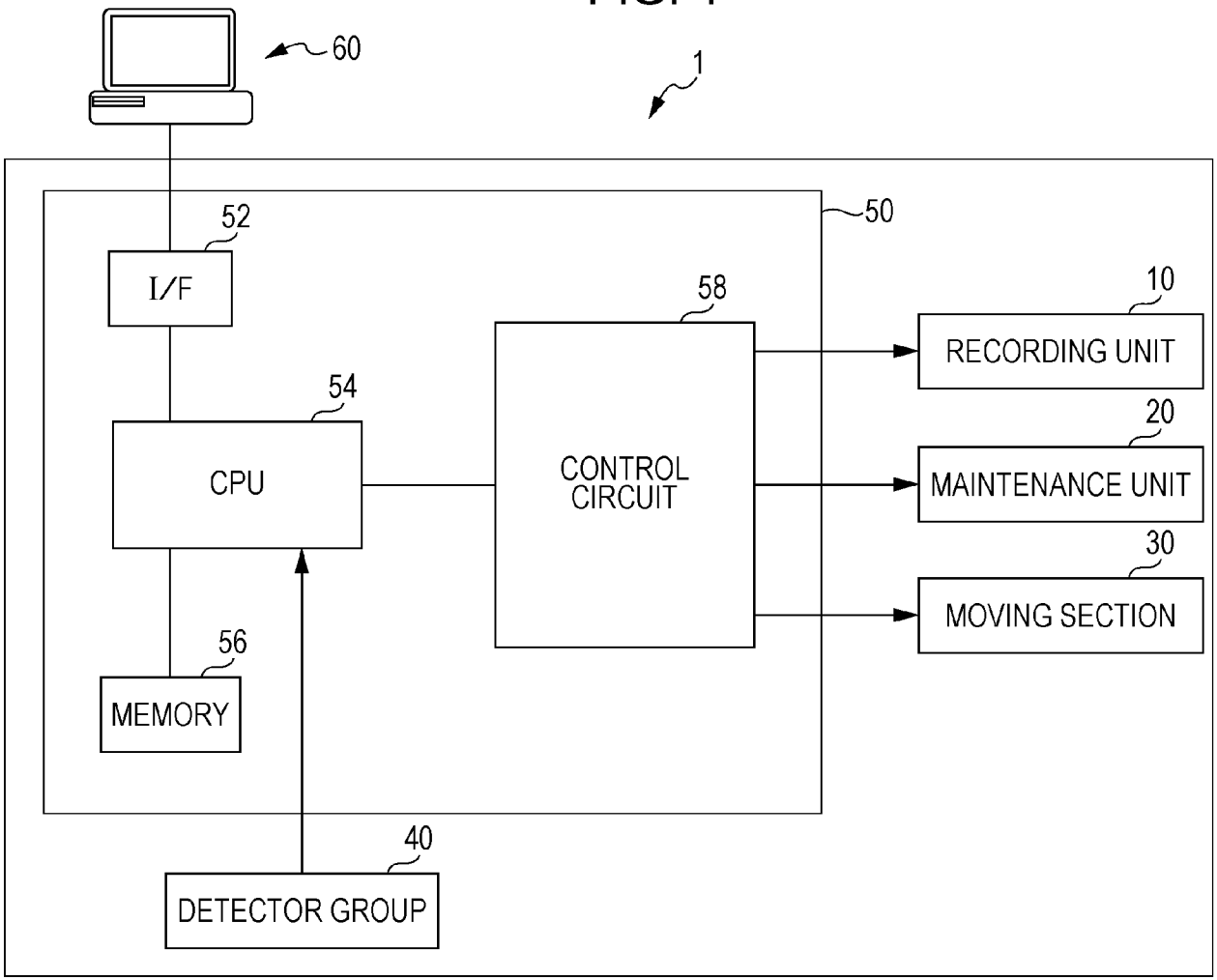
FIG. 1 is a block diagram which shows a configuration of an ink jet recording apparatus according to one embodiment of the invention.

FIG. 1 is a block diagram which shows a configuration of an ink jet recording apparatus 1 (referred to below as a "printer 1") according to the present embodiment.

Figure 2:
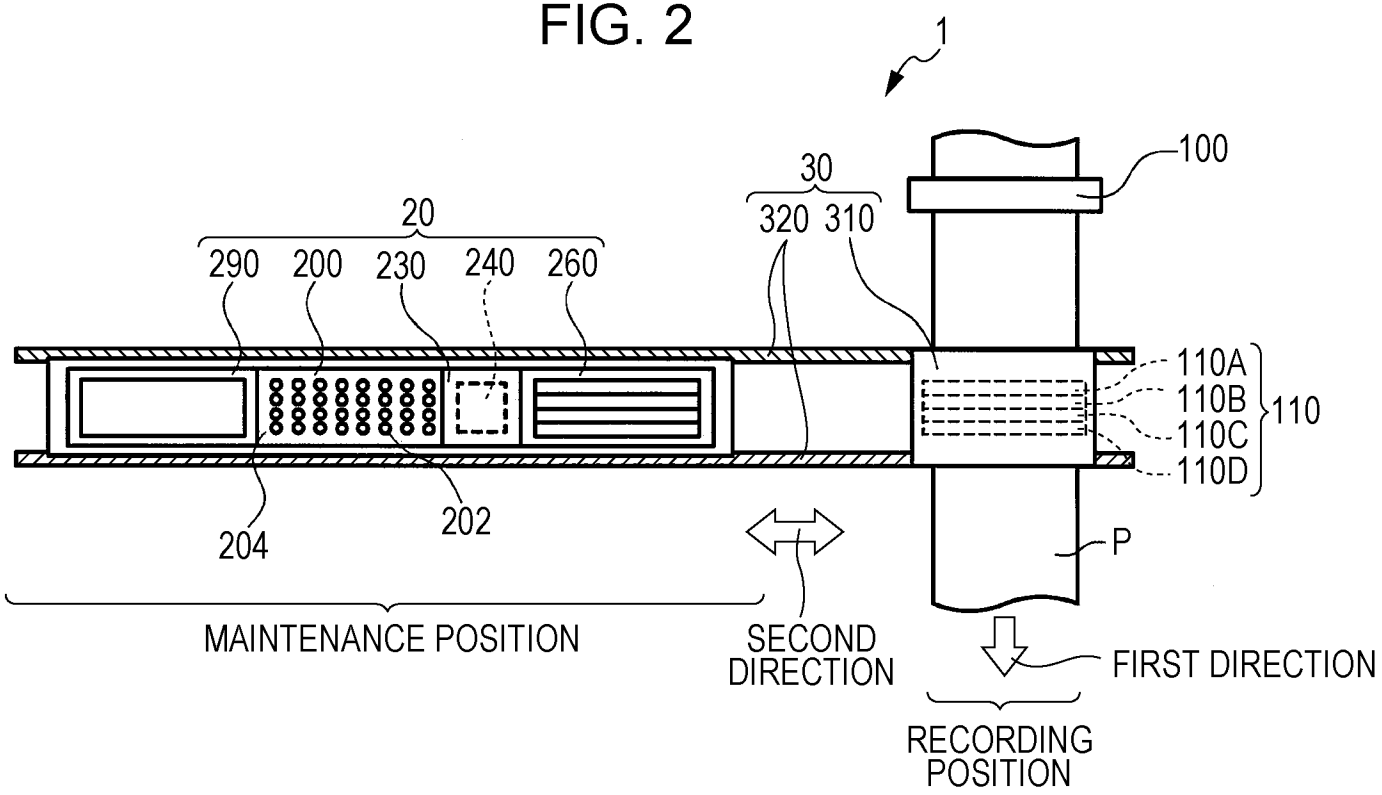
FIG. 2 is a planar schematic diagram which shows a configuration of an ink jet recording apparatus according to one embodiment of the invention.

FIG. 2 is a planar schematic diagram which shows the configuration of the printer 1. The first direction in FIG. 2 matches the transport direction of a recording medium P. In addition, the second direction in FIG. 2 is a direction which intersects with the first direction on the recording surface of the recording medium P, and matches the direction in which a recording head 110 and a maintenance unit 20 are relatively moved during a maintenance operation.

As shown in FIG. 1, the printer 1 has a recording unit 10, the maintenance unit 20, a moving section 30, a detector group 40, and a controller 50. The printer 1 which receives image data and maintenance instructions from an input unit 60 which inputs image data controls each of the means using the controller 50.

The controller 50 controls the recording unit 10 based on the image data which is received from the input unit 60 and records an image on the recording medium P (performs a recording operation). The image data which is received by the printer 1 from the input unit 60 may be image data where the input unit 60 has carried out a process such as conversion of the data with respect to image data which is input from another apparatus (which is not shown) to the input unit 60.

In addition, the controller 50 controls the recording unit 10 based on the maintenance instructions which are received from the input unit 60 and performs maintenance of the recording head 110 (performs a maintenance operation). Here, the maintenance operation is not limited to being performed by being input to the controller based on the maintenance instructions which are input to the input unit 60 and may be performed by storing a timing or the like for performing maintenance in the controller 50.

The status of the inside of the printer 1 is monitored by the detector group 40 and the detector group 40 outputs a detection result to the controller 50. The controller 50 controls each of the means based on the detection result which is output from the detector group 40.

In more detail, the controller 50 is a control unit for performing control of the printer 1 and has an interface section 52, a CPU 54, a memory 56, and a control circuit 58. The interface section 52 performs the reception and transmission of data between the input unit 60 and the printer 1. The CPU 54 is a calculation processing apparatus for performing control of the entire printer 1. The memory 56 is for securing a region which stores the programs of the CPU 54 and an operation region, and is provided with a storage element such as RAM or EEPROM. The CPU 54 controls each of the unit via the control circuit 58 according to the programs which are stored in the memory 56.

The input unit 60 is a unit for inputting the image data which is to be recorded on the recording medium P and inputting the maintenance instructions, and may be provided with a function which carries out data conversion on the image data which is input from another apparatus. Examples of the input unit 60 include a PC, a touch panel type input apparatus, and the like.

1.1.1. Recording Unit

The printer 1 according to the present embodiment has the recording unit 10 which records an image at a predetermined position on a recording medium. In the example of FIG. 2, the recording unit 10 has a transport section 100 which transports the recording medium P in the first direction, and recording heads 110 which record an image by attaching liquid droplets of an ink composition to the recording surface of the recording medium P.

It is possible for the transport section 100 to be configured by, for example, a roller, or the like. The transport section 100 may have a plurality of rollers. In the illustrated example, the transport section 100 is provided to the upstream side of the recording head 110 in the first direction; however, without being limited to this, the position where the transport section 100 is provided and the number thereof are arbitrary as long as it is possible to transport the recording medium P. The transport section 100 may be provided with a sheet supplying roll, a sheet supplying tray, a discharge paper roll, a paper discharge tray, various types of platens and the like.

The recording heads 110 are so-called line heads where one of the recording medium P or the recording heads 110 is fixed during the recording of the image with respect to the recording medium P, and nozzles are formed across the entire width direction (the second direction) of the recording medium. In the example of FIG. 2, the recording heads 110A, 110B, 110C, and 110D are arranged to be lined up along the first direction, and are provided independently according to the type (for example, the color) of ink to be discharged. In the example of FIG. 2, the number of the recording heads 110 is four; however, without being limited to this, the number may be 3 or less or may be five or more.

Any system may be used as the ink jet recording system of the recording heads 110, for example, it is possible to use a system where, by applying a strong electric field between the nozzles and acceleration electrodes which are placed in front of the nozzles and continuously discharging ink from the nozzles in the form of liquid droplets, recording is performed by applying a printing information signal to deflecting electrodes while the ink liquid droplets are flying between the deflecting electrodes; a system where the ink liquid droplets are discharged corresponding to the printing information signal without being deflected (an electrostatic attraction method); a system where the ink liquid droplets are forcibly discharged by applying pressure to the ink liquid with a small pump and the nozzles are mechanically vibrated by a quartz vibrator or the like; a system where the printing information signal is applied at the same time as pressure to the ink by a piezoelectric element and the ink liquid droplets are discharged and recorded (a piezo system); a system where the ink is heated and foamed by micro electrodes according to the printing information signal and the ink droplets are discharged and recorded (a thermal jet system); and the like.

Figure 3:
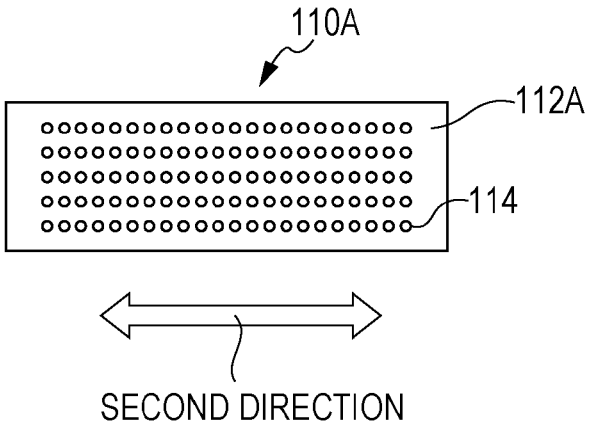
FIG. 3 is a diagram which schematically shows a nozzle forming surface of a recording head in the ink jet recording apparatus according to one embodiment of the invention.

FIG. 3 is a diagram which schematically shows a nozzle forming surface 112 of the recording heads 110. In the example of FIG. 3, a plurality of nozzles (nozzle openings) 114 which are able to discharge ink are provided on a nozzle forming surface 112A and a liquid repellent film (not shown) is provided on the surface of the nozzle forming surface 112A.

The arrangement and number of the nozzles 114 is not limited to the aspect which is shown in FIG. 3 and any well-known aspect may be used.

The liquid repelling film is not particularly limited as long as it is a film which has a liquid repelling property, for example, it is possible to form the film by film-forming a molecular film of a metal alkoxide which has a liquid repelling property and then applying a drying process, an annealing process, and the like. The molecular film of metal alkoxide may be any film as long as it has a liquid repelling property; however, a monomolecular film of a metal alkoxide which has a long-chain polymer group (a long-chain RF group) which includes fluorine or a monomolecular film of a metal salt which has a liquid repelling group (for example, a long-chain polymer group which includes fluorine) is desirable. The metal alkoxide is not particularly limited; however, for example, silicon, titanium, aluminum, and zirconium are generally used as the type of metal. Examples of the long-chain RF group include a perfluoroalkyl chain, or a perfluoropolyethyl chain. Examples of an alkoxysilane which has the long-chain RF group include a silane coupling agent which has a long-chain RF group. The liquid repelling film is not particularly limited and it is possible to use, for example, a silane coupling agent (SCA) film or those which are described in Japanese Patent No. 4424954. Here, in particular, films which have a liquid repelling property are referred to as liquid repelling films.

In addition, a conductive film may be formed on the substrate (the nozzle plate) where the nozzles are formed and the liquid repelling film may be formed on the conductive film; however, a base film (Plasma Polymerization Silicone (PPSi) film) may be formed by plasma polymerization of a silicon material in advance and the liquid repelling film may be formed on the base film. It is possible to adapt the liquid repelling film to the silicon material of the nozzle plate by interposing the base film.

The liquid repelling film preferably has a thickness of 1 nm or more and 30 nm or less, more preferably has a thickness of 1 nm or more and 20 nm or less, and even more preferably has a thickness of 1 nm or more and 15 nm or less. By being in the ranges described above, the nozzle forming surface 112 has a tendency to have a superior liquid repelling property, the deterioration of the film is comparatively slow, and it is possible to maintain the liquid repelling property for a longer period. In addition, film forming in the ranges described above is also excellent in terms of cost and in ease of film forming.

A nozzle plate cover (not shown) which covers at least a part of the nozzle forming surface 112 may be provided on the nozzle forming surface 112. The nozzle plate cover is provided on the nozzle forming surface 112 in a head where a plurality of nozzle tips (referred to below simply as "tips") are formed in combination in order to fulfill at least one out of a role of fixing the tips on the nozzle forming surface 112 or a role of preventing the recording medium from floating up such that the recording medium comes into direct contact with the nozzles. The nozzle plate cover described above is provided in a state of protruding from the nozzles 114 when viewed from the side surface by covering at least a part of the nozzle forming surface 112. In a case where the nozzle plate cover is provided, the ink composition (which will be described later) is likely to remain at the corners (the gaps) between the nozzle forming surface and the nozzle plate cover which protrudes therefrom. In this manner, the adhesion between the capping section (which will be described later) and the nozzle forming surface 112 is insufficient due to the solidifying of the inorganic pigments or the like which are included in the ink composition which remains at the corners, whereby capping operation failures may occur. Such problems may be particularly remarkable according to the type of resin which is included in the ink composition. Even in such a case, when an absorbing member 230 which will be described later is used, it is possible to remove the ink composition which is deposited in the gaps described above by the absorbing member coming into contact between the nozzle plate cover and the nozzles 114, and the capping operation is stable, which is favorable.

In FIG. 3, description has been given with the recording head 110A out of the recording heads 110 as an example; however, since it is possible for the recording heads 110B to 110D to have the same configuration, description thereof will be omitted.

Figure 4A:
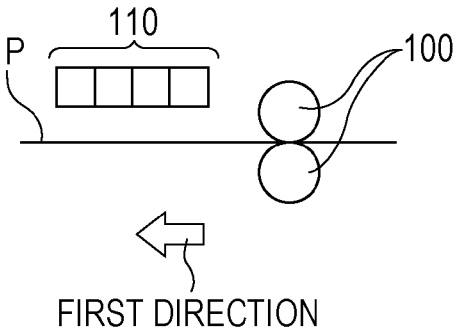
FIGS. 4A and 4B are side views which schematically show the arrangement relationship of a transport section and a recording head of a recording medium in the ink jet recording apparatus according to one embodiment of the invention.
Figure 4B:
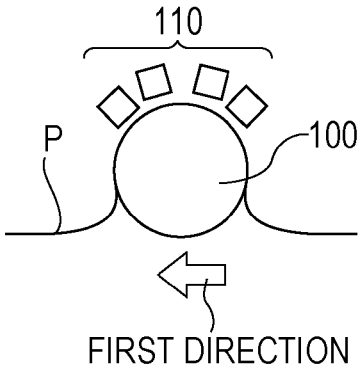

FIGS. 4A and 4B are side views which schematically show the arrangement relationship of the transport section 100 and the recording head 110. Specifically, in FIG. 4A, each of the recording heads 110 is arranged in parallel in the horizontal direction (here, the first direction). In FIG. 4B, each of the recording heads 110 is provided in the periphery of the transport section 100 (the transport roller) and each of the recording heads 110 is arranged to be inclined with respect to the horizontal direction (here, the first direction). In the printer 1 in FIG. 2, the arrangement relationship of the transport section 100 and the recording heads 110 has the aspect which is shown in FIG. 4A; however, without being limited to this, the arrangement relationship may have the aspect which is shown in FIG. 4B.

In the present embodiment, description has been given with the line head type printer 1 as described above as an example; however, without being limited to this, the printer may be a so-called serial head type printer where the recording heads are mounted on a carriage which moves in a predetermined direction and the liquid droplets are discharged onto the recording medium by moving the recording heads according to the movement of the carriage. In addition, the printer may be a lateral type printer which is provided with a recording head (a carriage) where mechanisms are provided which move in the X direction and the Y direction (the main scanning direction and the sub-scanning direction) as described in JP-A-2002-225255, an example of which is the SurePress L-4033 A (manufactured by Seiko Epson Corporation) which is a lateral type printer.

The recording unit 10 may further have a treatment liquid applying mechanism (which is not shown) or a heating mechanism (which is not shown). The treatment liquid applying mechanism is not particularly limited as long as a mechanism is provided which attaches a treatment liquid, which includes a component which aggregates components such as pigments which are included in the ink composition, to the recording medium P, and, for example, it is possible to use a mechanism or the like which is provided with a well-known impregnation roll. The heating mechanism is not particularly limited as long as it is provided with a configuration which promotes the evaporation and scattering of the liquid medium which is present in the ink composition, and it is possible to use a heating mechanism which is provided with a mechanism for forced air heating, radiant heating, conductive heating, high frequency drying, microwave drying, or the like.

1.1.2. Maintenance Unit

The printer 1 according to the present embodiment has the maintenance unit 20 for preserving the recording heads 110. It is necessary for the ink jet recording apparatus according to the invention to have at least a cleaning liquid applying unit, an absorbing member, and a wiping unit as the maintenance unit; however, when there is at least one of the first capping section and the second capping section, there are cases where the maintenance performance is improved.

Below, description will be given of a case where a cleaning liquid applying unit 200, the absorbing member 230, a wiping unit 240, a first capping section 260, and a second capping section 290 are provided as an example of the maintenance unit 20 of the printer 1 according to the present embodiment.

In the example of FIG. 2, the maintenance unit 20 is arranged at a maintenance position. The maintenance position refers to a position where the preservation of the nozzle forming surface 112 is performed. In the example of FIG. 2, the maintenance position is parallel with the recording position (a position where the image is recorded on the recording medium P) along the second direction; however, without being limited to this, the maintenance position may be any position such as a position which faces the nozzle forming surface 112, for example.

Cleaning Liquid Applying Unit

The cleaning liquid applying unit 200 is used in order to apply a cleaning liquid (which will be described later) to the nozzle forming surface 112. In the example of FIG. 2, the cleaning liquid applying unit 200 is provided with a plurality of cleaning liquid supply ports 202 which discharge the cleaning liquid, and a cleaning liquid holding surface 204 which holds the cleaning liquid which is supplied from the cleaning liquid supply ports 202. According to the example of FIG. 2, it is possible to apply a liquid film which is formed of the cleaning liquid on the nozzle forming surface 112 by the nozzle forming surface 112 coming into contact with the liquid film of the cleaning liquid which is formed on the cleaning liquid holding surface 204.

In the example of FIG. 2, a case is shown where the cleaning liquid supply ports 202 and the cleaning liquid holding surface 204 are on the same horizontal plane; however, without being limited to this, there may be an aspect where the cleaning liquid supply ports 202 and the cleaning liquid holding surface 204 are present at separate positions, that is, where the cleaning liquid supply ports 202 and the cleaning liquid holding surface 204 are provided at positions which face each other. In addition, description has been given of a system which holds the liquid film on the surface and which transfers the liquid film; however, this is not limiting. The liquid film may be formed by accumulating the cleaning liquid on the bottom surface (the cleaning liquid holding surface) which has the shape of a holding container and bringing the cleaning liquid into contact with the nozzle forming surface 112.

On the other hand, in a case where the printer 1 according to the present embodiment is not provided with the cleaning liquid holding surface 204, for example, it is possible to apply the cleaning liquid to the nozzle forming surface 112 by applying the cleaning liquid on the cleaning liquid supply ports 202 to the nozzle forming surface 112, by applying the cleaning liquid from the cleaning liquid supply ports 202 to the nozzle forming surface 112 dropwise, or by using a mechanism (a spraying apparatus) which sprays the cleaning liquid from the cleaning liquid supply ports 202, a mechanism which ejects the cleaning liquid, or the like. That is, the printer 1 according to the present embodiment is not limited to an aspect where the liquid film of the cleaning liquid which is held on the cleaning liquid holding surface 204 comes into contact with the nozzle forming surface 112, and the liquid film may be formed on the nozzle forming surface 112 by attaching the cleaning liquid to the nozzle forming surface 112 without forming the liquid film of the cleaning liquid at the cleaning liquid applying unit 200 side.

The method of supplying the cleaning liquid to the cleaning liquid supply ports 202 is not particularly limited; however, for example, it is possible to perform supply to the cleaning liquid supply ports 202 which are connected with a cleaning liquid supply path by supplying the cleaning liquid which is stored in a cleaning liquid storage tank to the cleaning liquid supply path using a pump or the like.

Absorbing Member

The absorbing member 230 is used in order to clean (wipe off) the nozzle forming surface 112 by absorbing (or adsorbing) attachments (for example, the ink composition, the cleaning liquid, fibers, paper, dust, and the like) which are attached to the nozzle forming surface 112 and the nozzles 114 using a wiping unit which will be described later.

Here, in a case where inorganic pigments (which will be described later) are included in the ink composition, the liquid repelling film which is provided on the nozzle forming surface 112 is easily damaged by the wiping off of the nozzle forming surface 112. Even in such a case, by wiping off the attachments on the nozzle forming surface 112 using the absorbing member 230 by adjusting the pressing load to a predetermined range, the inorganic pigment particles are absorbed into the absorbing member 230 and the pigment particles do not remain on the surface of the absorbing member 230 and damage to the liquid repelling film due to the inorganic pigment particles is suppressed due to the strong pressing.

The absorbing member 230 is not particularly limited; however, examples thereof include fabric, sponge, pulp, and the like. Among these, fabric is preferable. Fabric is easy to bend, and in a case where the nozzle plate cover is provided, the ink which is attached to the nozzle forming surface 112 is particularly easy to wipe off. In addition, the fabric is not particularly limited and examples thereof include fabrics formed of cupra, polyester, polyethylene, polypropylene, lyocell, rayon, and the like. At this time, in particular, since scuffing is small when the material of the absorbing member is a non-woven fabric formed of polyester, cupra, or the like, this is preferable since the ink is not easily suctioned from the nozzles 114 and missing dots are less likely to be caused.

The thickness of the absorbing member 230 is preferably 0.1 mm or more and 3 mm or less. By the thickness being 0.1 mm or more, the absorption of the cleaning liquid and the ink composition is improved and the pushing in or the like of foreign matter into the nozzles is reduced. In addition, by the thickness being 3 mm or less, the absorbing member is compact, it is possible to miniaturize the entire maintenance unit, and it is easier to move the maintenance unit in a case where the maintenance unit is moved.

The surface density of the absorbing member 230 is preferably 0.005 $g/cm^2$ or more and 0.15 $g/cm^2$ or less, and more preferably 0.02 $g/cm^2$ or more and 0.13 $g/cm^2$ or less. By being in ranges described above, there is a tendency for the absorption of the cleaning liquid and the ink composition to be further improved. Furthermore, from the point of view of further improving the absorption of the cleaning liquid and the ink composition, it is preferable to use non-woven fabric, for which setting the surface density and the thickness is easy, as the absorbing member.

Wiping Unit

The wiping unit 240 has a pressing mechanism which presses the absorbing member 230 and the nozzle forming surface 112, and a driving mechanism which wipes off the nozzle forming surface 112 by relatively moving the absorbing member 230 with respect to the nozzle forming surface 112.

The pressing mechanism presses the absorbing member 230 and the recording heads 110 by relatively moving at least one out of the absorbing member 230 and the recording heads 110 with respect to the other. It is necessary for the pressing mechanism to press the absorbing member 230 and the recording heads 110 with a load (linear pressure) of 8 gf/cm or more to 150 gf/cm or less; however, a load of 12.5 gf/cm or more to 100 gf/cm or less is preferable, and pressing with a load of 12.5 gf/cm or more to 58 gf/cm or less is more preferable. By the load being 8 gf/cm or more, the ink wiping property is excellent. Furthermore, even in a case where there is a step between the nozzle plate and the nozzle plate cover, the prevention of the ink from being attached and deposited in this gap and the removal of the ink from the gap are excellent. In addition, by the load being 150 gf/cm or less, the storability of the liquid repelling film is superior. Here, the load referred to here is a value obtained by dividing the total of the loads, which are applied to the recording heads 110 by the entire pressing mechanism, by the contact length (in other words, the average linear pressure). Furthermore, the contact length is the contact length of the recording heads 110 and the absorbing member 230 in the longitudinal direction, and, in a case where the nozzle plate cover and the absorbing member are in contact, this length is also included.

The pressing mechanism is not particularly limited; however, the pressing mechanism may have a pressing member. For example, it is possible for the pressing member to bring the absorbing member 230 and the nozzle forming surface 112 into contact by pressing the absorbing member 230 from the side which is opposite to the side which comes into contact with the nozzle forming surface 112. Here, description has been given of an aspect where the absorbing member is moved; however, without being limited to this, the aspect may be one where the absorbing member 230 and the nozzle forming surface 112 are brought into contact by moving the recording heads 110 using the pressing mechanism.

The pressing member is not particularly limited; however, for example, a pressing member which is covered with an elastic member is preferable. The Shore A hardness of the elastic member is preferably 10 or more and 60 or less, and more preferably 10 or more and 50 or less. Due to this, the pressing member and the absorbing member are bent during the pressing and it is possible to push the absorbing member into the depths of the uneven surface which forms the nozzle forming surface. In particular, in a case where there is a nozzle plate cover, it is possible to push the absorbing member into the depths of the corners (the gaps) between the nozzle forming surface and the nozzle plate cover which protrudes therefrom, and it is possible to suppress the deposition of ink. Therefore, the cleaning property is further improved.

The driving mechanism wipes off the nozzle forming surface 112 by relatively moving at least one out of the absorbing member 230 and the recording heads 110 (the nozzle forming surface 112) with respect to the other in a state where the nozzle forming surface 112 and the absorbing member 230 are in contact with the pushing pressure described above due to the pressing mechanism described above. By doing so, the attachments on the nozzle forming surface 112 are absorbed into the absorbing member 230 and the cleaning (the wiping) of the attachments on the nozzle forming surface 112 is performed.

The driving operation of the driving mechanism is not particularly limited; however, examples thereof include an operation of moving the absorbing member 230 which is provided along the roller by rotating the roller using driving force of a motor or the like, or an operation of moving a head which is mounted on a rail or the like. The driving mechanism may move the absorbing member 230 and the nozzle forming surface 112 in one direction or may cause the absorbing member 230 and the nozzle forming surface 112 to reciprocate.

The driving mechanism preferably relatively moves the absorbing member 230 and the recording heads 110 (the nozzle forming surface 112) at a speed of 1 cm/s or more and 10 cm/s or less. By being in the ranges described above, it is possible to improve the cleaning property and the storability of the liquid repelling film, and it is possible to reduce the maintenance time. Here, the speed is equivalent to the wiping speed during the wiping operation which will be described later. In addition, it is preferable that the speed be 3 cm/s or more and 9 cm/s or less and, due to this, the effects described above are even more remarkable.

A specific example of the wiping unit 240 which is provided with the pressing mechanism and the driving mechanism will be described in more detail in FIG. 5 and FIGS. 6A and 6B.

Figure 5:
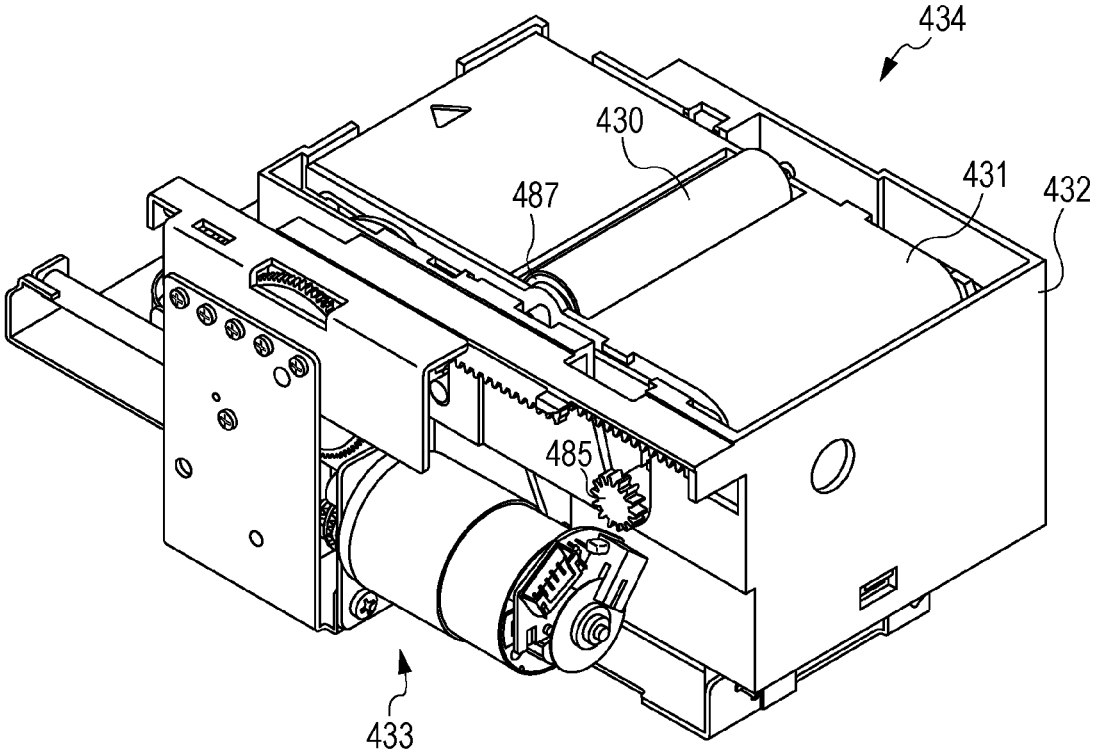
FIG. 5 is a perspective view which schematically shows a wiper unit in the ink jet recording apparatus according to one embodiment of the invention.

FIG. 5 is a perspective view of a wiper unit 434 which is an example of the wiping unit 240. FIG. 6A is a front view of a wiper cassette 431 and FIG. 6B is a front view of the wiper cassette 431 with the housing omitted.

The wiper unit 434 has the wiper cassette 431 where an absorbing member 430 (230) which wipes off the attachments on the nozzle forming surface 112 of the recording heads 110 is mounted, a wiper holder 432 where the wiper cassette 431 is mounted so as to be freely attached and detached, and a movement mechanism 433 which moves the wiper holder 432 in the nozzle row direction (the second direction in FIG. 2) of the recording heads 110. Here, the driving mechanism described above relatively moves the absorbing member 430 and the nozzle forming surface 112 and, in the example of FIG. 5 and FIGS. 6A and 6B, includes at least the movement mechanism 433, a feeding roller 481, a winding roller 482, and a shaft section 487*a*.

Figure 6A:
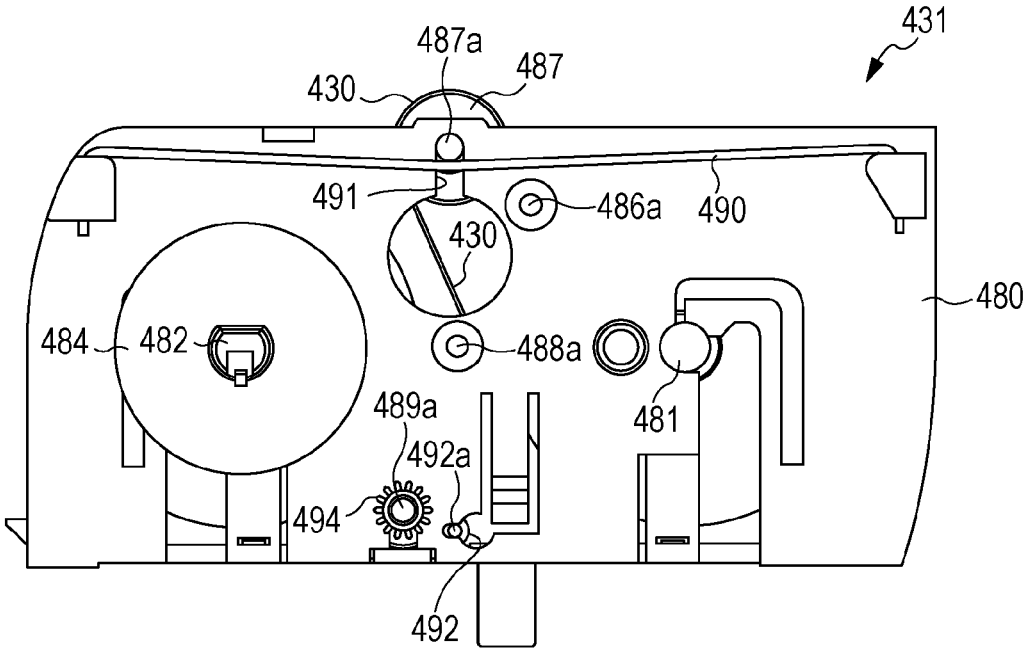
FIGS. 6A and 6B are diagrams which schematically show a wiper cassette in the ink jet recording apparatus according to one embodiment of the invention.
Figure 6B:
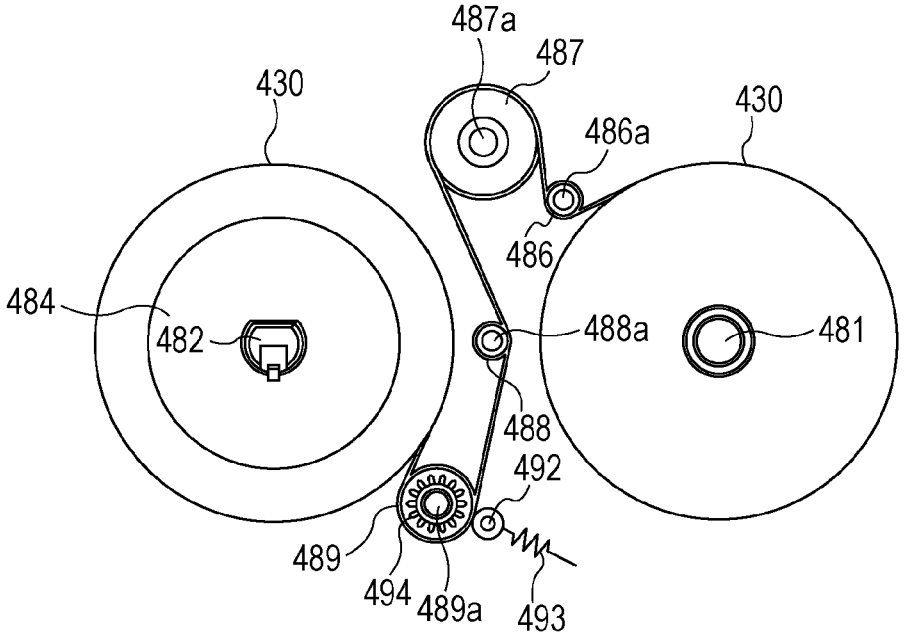

As shown in FIGS. 6A and 6B, in the inside of a housing 480 which forms a substantially rectangular box shape which configures the exterior of the wiper cassette 431, a pair of rollers 481 and 482 which have axes which extend horizontally in the front and back direction which is the lateral direction of the housing 480 are accommodated at a distance in the left and right direction which is the longitudinal direction of the housing 480. The longitudinal direction of the housing 480 preferably matches the second direction. An elongated absorbing member 430 for wiping off the attachments from the nozzle forming surface 112 of the recording heads 110 is wound between the pair of rollers 481 and 482. Then, in the pair of rollers 481 and 482, the feeding roller 481 which is the first roller feeds out the unused wound absorbing member 430. On the other hand, in the pair of rollers 481 and 482, the winding roller 482 which is the second roller winds up the used absorbing member 430 which was unwound from the feeding roller 481 and used in the wiping off. Here, the feeding roller 481 and the winding roller 482 are positioned at substantially the same heights as each other. In addition, at one end section (a front end section) in the axial direction of the feeding roller 481 which is exposed to the outside of the housing 480, a feeding gear is provided so as to be able to rotate integrally with the feeding roller 481. In addition, at both end sections in the axial direction of the winding roller 482 which is exposed to the outside of the housing 480, winding gears 484 and 485 are provided so as to be able to rotate integrally with the winding roller 482.

In addition, inside the housing 480, a plurality (four in the present embodiment) of rollers 486, 488, and 489 and a pressing member 487 are provided on the feeding path of the absorbing member 430 from the feeding roller 481 to the winding roller 482. These rollers 486, 488, and 489 and the pressing member 487 extend to the front and back in parallel with the feeding roller 481 and the winding roller 482 and both ends in the front and back direction thereof are supported to be freely rotatable by a bearing section which is provided in a side wall section of the housing 480.

Specifically, a portion of the absorbing member 430 which is fed out from the feeding roller 481 is wound in the pressing member 487 which is provided at the upper right of the feeding roller 481. The shaft section 487*a* of both ends of the pressing member 487 in the axial direction is supported from below by rod springs 490 which are fixed to both the outer side surfaces of the front and back of the housing 480. The rod springs 490 support the shaft section 487*a* of the pressing member 487 from below at an intermediate position in the longitudinal direction. Here, the shaft section 487*a* of the pressing member 487 is inserted at the front and back with respect to bearing holes 491 which are provided in the housing 480 and is in close contact with the hole edges at the upper side of the bearing holes 491 according to an upward biasing force which acts from the rod springs 490. Then, the shaft section 487*a* of the pressing member 487 is supported from both above and below to be able to freely rotate between the rod springs 490 and the hole edges of the bearing holes 491. In addition, the uppermost section of the circumferential surface in the pressing member 487 is positioned above the upper surface of the housing 480 and the portion of the absorbing member 430 which is wound on the pressing member 487 protrudes upward from the upper surface of the housing 480. In addition, the uppermost section of the circumferential surface of the pressing member 487 is positioned above the nozzle forming surface 112 of the recording heads 110.

It is possible for the pressing mechanism of the present embodiment which includes at least the rod springs 490 and the pressing member 487 to apply a pressing load by pressing the absorbing member 430 with respect to the nozzle forming surface 112 using the upward biasing force due to the rod springs 490. The pressing load in the present embodiment indicates a spring load. Here, as long as the mechanism which applies the pressing load is a mechanism which presses the absorbing member 430 to the nozzle forming surface 112 with a constant load, the mechanism may use rubber or the like instead of just the spring, or the load may be applied with a method such as applying a load by controlling the mechanical members electrically without using the above.

In addition, a relay roller 489 where a portion of the absorbing member 430 which is fed out from the pressing member 487 is wound is provided vertically below the pressing member 487. In addition, a pinching roller 492 which pinches the absorbing member 430 with the relay roller 489 is provided at a position on the opposite side with respect to the relay roller 489 while interposing the absorbing member 430. In addition, a spring member 493 is interposed as a biasing member between the bottom wall inner surface of the housing 480 and the pinching roller 492. Here, the pinching roller 492 is biased by the spring member 493 in a direction which approaches the relay roller 489.

Here, a relay gear 494 is provided so as to be able to rotate integrally with the relay roller 489 at the end section of a shaft section 489*a* on one side (the rear side in FIGS. 6A and 6B) of the relay roller 489 in the axial direction which is exposed from the side wall section on the housing 480 to the outside. In addition, end sections of a shaft section 492*a* of both ends of the pinching roller 492 in the axial direction are exposed to the outside from a bearing section with a notched groove shape which is formed when an elastic piece is notched and formed in the side wall section of the housing 480.

In addition, on the feeding out path of the absorbing member 430 from the feeding roller 481 up to the winding roller 482, tension rollers 486 and 488 which apply tension with respect to the absorbing member 430 are provided between the feeding roller 481 and the pressing member 487 and between the pressing member 487 and the relay roller 489. Here, end sections of the shaft sections 486*a* and 488*a* of both ends of the tension rollers 486 and 488 in the axial direction are exposed to the outside from a bearing section with a circular concave shape which is provided in the side wall section of the housing 480.

In the example of FIG. 5, FIGS. 6A and 6B, an aspect where the absorbing member 430 and the nozzle forming surface 112 are pressed using one pressing member 487 with a roller shape is shown; however, without being limited to this, for example, the aspect may use two or more pressing members with a roller shape.

In a case where the pressing member 487 presses the absorbing member 430 and the nozzle forming surface 112 together, the shape of the contact section of the absorbing member 430 and the nozzle forming surface 112 changes from a line which extends in the longitudinal direction of the pressing member 487 to the shape of the surface. However, without being limited to this aspect, the aspect may press the absorbing member 430 and the nozzle forming surface 112 using the pressing member 487 where the pressing surface is a rectangular shape so that the contact area of the absorbing member 430 and the nozzle forming surface 112 is widened, for example, so that the pressing area is widened.

First Capping Section

The maintenance unit 20 preferably further has the first capping section 260 which is provided with a suction mechanism. Since the first capping section 260 covers at least a part of the nozzle forming surface 112 and it is possible to suction the ink composition which is present in the nozzle 114, it is possible to improve the discharge stability of the ink.

For example, it is possible for the first capping section 260 to be provided with a cap member which forms a closed space with the nozzle forming surface 112 and a well-known suction mechanism such as a suction pump.

The cap member of the first capping section 260 may cover the recording heads 110A to 110D as a batch; however, it is preferable for a plurality of cap members to be provided so as to be able to cover each of the recording heads 110A to 110D. By carrying out the covering with the plurality of cap members which are provided for each of the recording heads 110A to 110D, since the volume inside the cap is reduced compared to a cap member which covers the recording heads 110A to 110D as a batch, there is an advantage in that the suction efficiency is excellent. In addition, it is possible to prevent the inks of different colors which are discharged from the other nozzles being attached to the nozzle.

The first capping section 260 is not limited to being used for the suctioning of the ink composition of the nozzles 114 and, for example, may be used for moisturizing by forming a closed space with the nozzle forming surface 112, and it is possible to use the first capping section 260 as a receptacle of ink which is evacuated when a flushing operation is performed which performs clogging prevention of the nozzles due to the thickening of ink by discharging the ink from the nozzles 114 or which discharges the ink normally from the nozzles 114 by adjusting the menisci of the nozzles.

Second Capping Section

The maintenance unit 20 preferably further has the second capping section 290 which moisturizes by forming a closed space with the nozzle forming surface 112. Due to this, since it is possible to suppress solidification or the like of the ink which is present inside the nozzles 114, the discharge stability of the ink is improved.

It is possible for the second capping section 290 to be provided with a capping member which forms (caps) a closed space with the nozzle forming surface 112, for example.

In addition, the second capping section 290 may have a moisturizing liquid in order to preserve the humidity inside the capping member during the capping of the nozzle forming surface 112. As a supply method, a moisturizing liquid supply mechanism which supplies moisturizing liquid to the cap member may be provided. As the moisturizing liquid supply mechanism, it is possible to adopt a well-known mechanism. In addition, as the moisturizing liquid, it is possible to use one which contains, for example, water, an organic solvent, or the like, and one with the same composition as the cleaning liquid which will be described later may be used. In addition, the cleaning liquid which will be described later may be reused as the moisturizing liquid.

The capping member which is used in the second capping section 290 preferably has a structure which forms a closed space with the recording heads 110A to 110D as a batch. Due to this, it is possible to moisturize the recording heads 110A to 110D as a batch. In addition, since it is not necessary to provide the moisturizing liquid supply mechanism for each of the recording heads 110A to 110D, it is possible to achieve miniaturization and simplification of the printer 1.

The printer 1 may be provided with any one of the first capping section 260 and the second capping section 290 described above; however, it is more preferable that both be provided. In a case where only the first capping section 260 is provided, it is possible to also use the first capping section 260 as a moisturizing cap; however, there are cases where the inner section of the cap member is soiled by the ink which is evacuated during the suction. In such a case, there are cases where the ink inside the cap member is attached to the nozzle forming surface 112 and the nozzle forming surface 112 is soiled during the moisturizing. In such a case, it is possible to keep the nozzle forming surface 112 clean during the moisturizing by having the second capping section 290 as the capping section dedicated to the moisturizing.

1.1.3. Moving Section

The printer 1 according to the present embodiment has the moving section 30 which is arranged at a position which faces the nozzle forming surface 112 and the maintenance unit 20 and which relatively moves the nozzle forming surface 112 and the maintenance unit 20. That is, the moving section 30 arranges the nozzle forming surface 112 at a maintenance position by moving at least one of the nozzle forming surface 112 and the maintenance unit 20. As a specific example, in a case where the recording heads 110 are moved to the left in FIG. 2, in a state where the recording heads 110 and the first capping section 260 face each other, the moving section 30 makes the wiping unit 240 and the recording heads 110 face each other by moving the recording heads 110. On the other hand, in a case where the recording heads 110 are moved to the right in FIG. 2, the moving section 30 makes the recording heads 110 and the wiping unit 240 face each other in a state where the cleaning liquid applying unit 200 and the recording heads 110 face each other. That is, the moving section 30 moves the nozzle forming surface 112 and each of the units (the cleaning liquid applying unit 200, the absorbing member 230, the first capping section 260, the second capping section 290, and the like described above) belonging to the maintenance unit 20 to positions facing each other and the moving direction is not particularly limited as long as it is possible to perform the movement from a non-facing state to a facing state. In other words, the movement in a direction which approaches or moves away from an already facing state is not included in the "moving directions" described above. By providing the moving section 30, it is possible to perform the maintenance operation or the like using each of the units belonging to the maintenance unit 20.

The moving mechanism of the moving section 30 is not particularly limited; however, for example, as shown in FIG. 2, examples include a moving mechanism which is provided with a driving belt 320 which connects a housing 310 where the recording heads 110 are mounted and the recording heads 110 and the maintenance unit 20 and which moves the housing 310. In the example of FIG. 2, it is possible to move the recording heads 110 to the maintenance position by driving the driving belt 320 using a driving motor or the like which is not shown in FIG. 2. Here, the example of FIG. 2 shows an aspect where the recording heads are moved; however, without being limited to this, the aspect may cause only the maintenance unit 20 to move, or the aspect may cause both of the recording heads 110 and the maintenance unit 20 to move. In addition, in a case where the recording heads 110, the cleaning liquid applying unit 200, the wiping unit 240, the first capping section 260, and the second capping section 290 are moved by the moving section 30, it is not necessary for the moving mechanism to be the same, and a design may be adopted where the movement is performed using separate moving mechanisms.

1.2. Arrangement of Maintenance Operation and Maintenance Unit 1.2.1. Maintenance Operation Description will be given of the maintenance operations which are able to be performed by the ink jet recording apparatus according to the invention with a case of using the printer 1 described above as an example.

Examples of the maintenance operation include a cleaning liquid applying operation, a wiping operation, a suction operation, a moisturizing operation, and the like. The cleaning liquid applying operation is an operation where a cleaning liquid is applied to the nozzle forming surface 112 using the cleaning liquid applying unit 200. The wiping operation is an operation where the nozzle forming surface 112 is wiped with the absorbing member 230 while pressing the absorbing member 230 onto the nozzle forming surface 112 using the wiping unit 240. The suction operation is an operation where the ink composition which is present in the nozzle 114 is suctioned using a suction mechanism after the nozzle forming surface 112 is covered by the first capping section 260. The moisturizing operation is an operation where moisturizing is performed by forming a closed space with the nozzle forming surface 112 using the second capping section 290.

Here, according to the moving section 30 described above, the operation of arranging the nozzle forming surface 112 and the maintenance unit 20 at a position facing each other and relatively moving the nozzle forming surface 112 and the maintenance unit 20 may be included in the maintenance operation.

The controller 50 (control unit) combines each of the maintenance operations described above or performs the maintenance operations individually based on a maintenance instruction which is received from the input unit 60 or on a timing which is stored in the controller 50 in advance. Here, examples of the timing for performing the maintenance operation include during start-up of the printer 1, during rest, during the recording of an image, or the like.

Each of the maintenance operations described above may be performed in any order; however, from the point of view of increasing the cleanness of the nozzle forming surface, it is preferable that the operations be performed in order of the cleaning liquid applying operation and the wiping operation. Due to this, compared to a case where the wiping operation is performed individually, the cleanness of the nozzle forming surface is further increased.

In a case where the printer 1 is in the rest state, it is preferable to perform the operations in the order of the cleaning liquid applying operation, the wiping operation, and the moisturizing operation. Due to this, in a case where the recording is restarted, the discharge stability of the ink is favorable.

The suction operation is performed in a case where the printer 1 is in the rest state, or a case where thickened ink inside the nozzles 114 or air bubbles which are mixed into the nozzles 114 or the like are evacuated. After the suction operation is performed, since there are cases where the nozzle forming surface 112 is soiled by the ink which is evacuated, it is preferable to use the wiping unit.

In the cleaning liquid applying operation, the clearance between the nozzle forming surface 112 and the cleaning liquid supply port 202 (a cleaning liquid holding surface 204) is not particularly limited as long as there is a clearance; however, more than 0 mm to 5 mm or less is preferable, 0.1 mm or more to 2 mm or less is more preferable, and 0.1 mm or more to 0.5 mm or less is even more preferable. When the clearance is within the ranges described above, the cleaning liquid is easily applied to the nozzle forming surface 112 and it is easy to form the liquid film formed of the cleaning liquid on the nozzle forming surface 112.

In the moisturizing operation (during the moisturizing), there is preferably no clearance between the nozzle forming surface 112 and the cap member of a second capping apparatus. That is, it is preferable to form a closed space due to the nozzle forming surface 112 and the second capping apparatus coming into contact. Due to this, it is possible to favorably moisturize the nozzles. In particular, since the invention which uses the absorbing member wipes extremely small remaining attachments, it is easy to form a favorable closed space in comparison with the techniques of the related art which use a rubber blade.

In the cleaning liquid applying operation, as the time for which the cleaning liquid comes into contact with the nozzle forming surface 112, 2 seconds or more is preferable, 2 seconds or more to 30 seconds or less is more preferable, and 3 seconds or more and 20 seconds or less is even more preferable. When the time is two seconds or more, the liquid film on the nozzle forming surface 112 permeates the attachments favorably and it is easy to perform the wiping. In addition, it is possible to achieve a shortening in the maintenance time by the time being 30 seconds or less.

1.2.2. Arrangement of Maintenance Unit

Next, description will be given of the arrangement relationship of each of the units which configure the maintenance unit. In the printer 1 described above, the first capping section 260, the absorbing member 230 (the wiping unit 240), a cleaning liquid applying unit 200, and the second capping section 290 are arranged in order from the side close to the recording position along the second direction; however, each of the unit may have any arrangement relationship without being limited to this.

Figure 7:
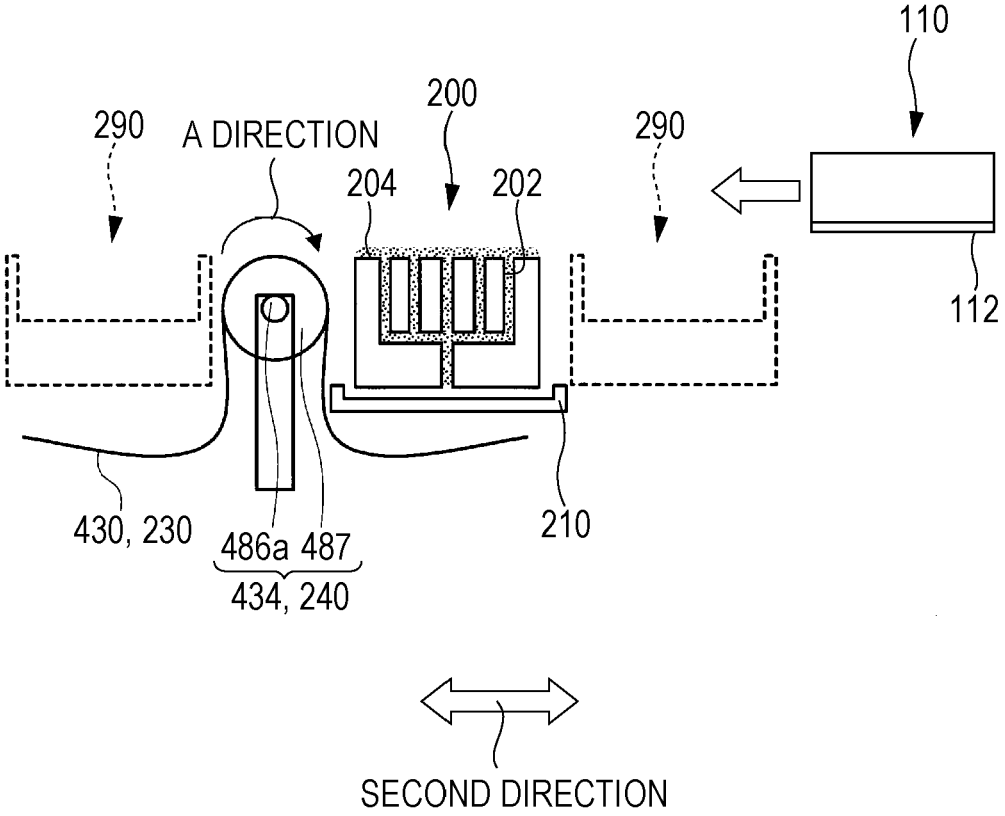
FIG. 7 is a diagram which schematically shows the arrangement relationship between a cleaning liquid applying unit and an absorbing member in the ink jet recording apparatus according to one embodiment of the invention.
Figure 8A:
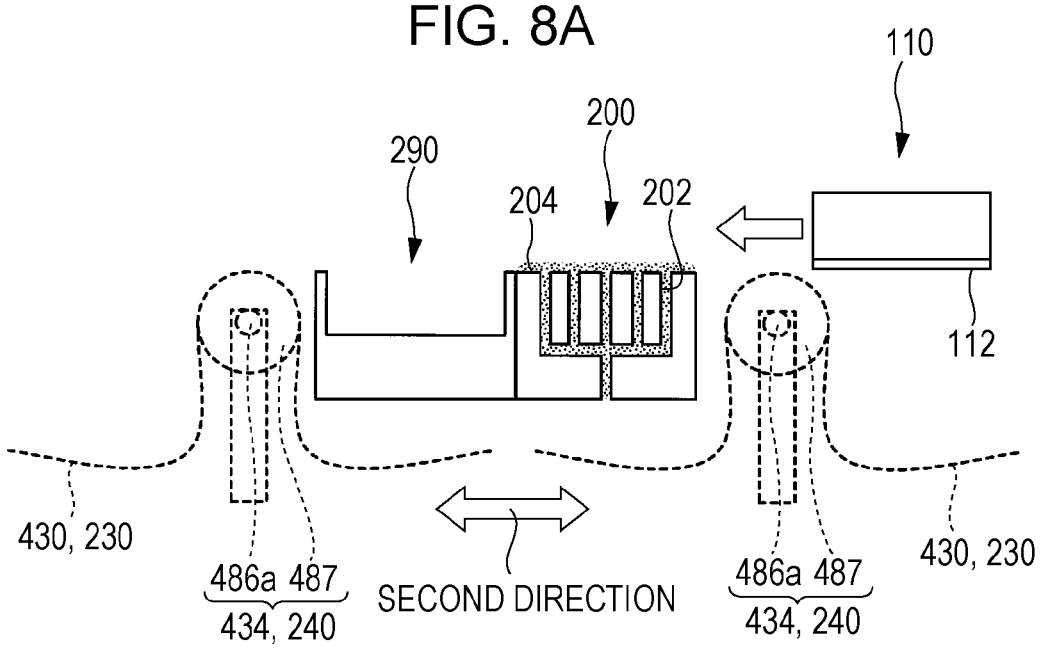
FIGS. 8A and 8B are diagrams which schematically show the arrangement relationship between the cleaning liquid applying unit and the second capping section in the ink jet recording apparatus according to one embodiment of the invention.
Figure 8B:
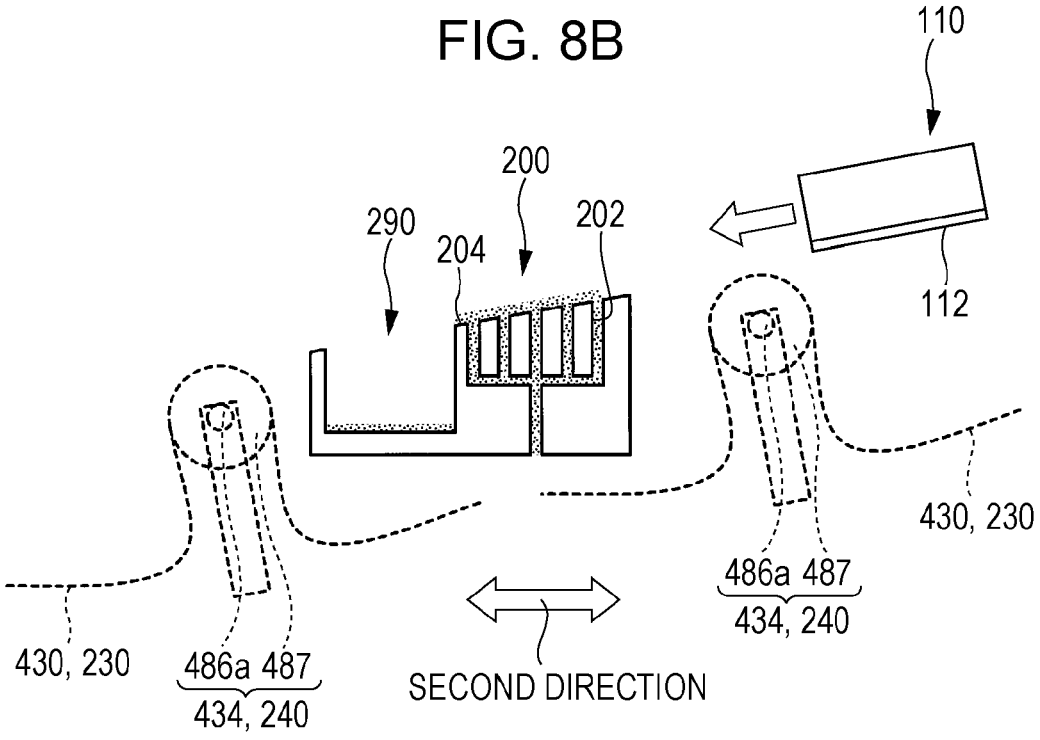
Figure 9:
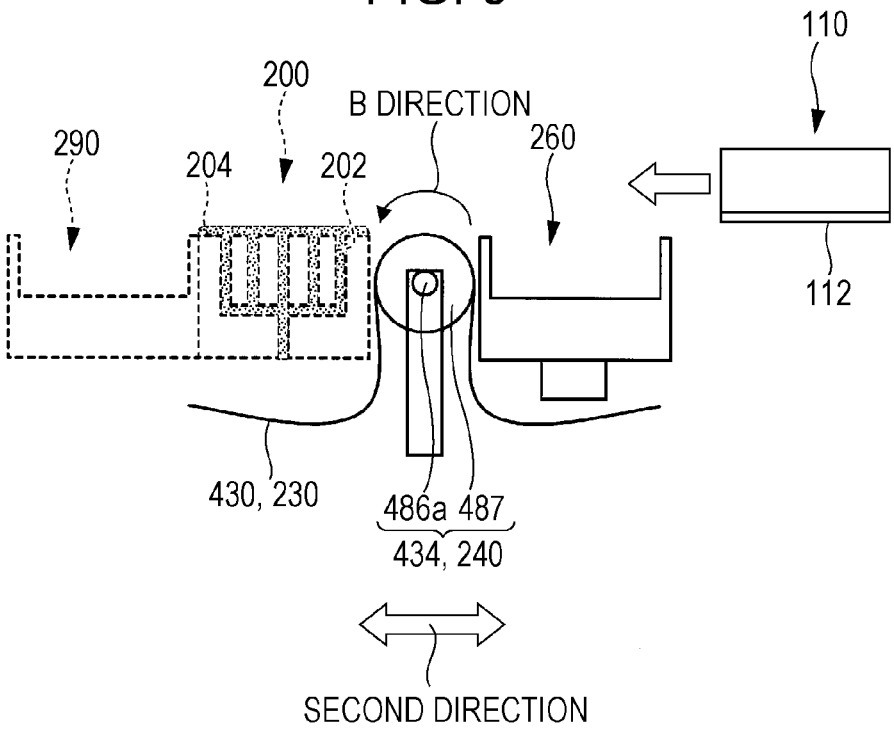
FIG. 9 is a diagram which schematically shows the arrangement relationship between the first capping section and the absorbing member in the ink jet recording apparatus according to one embodiment of the invention.

FIG. 7 to FIG. 9 are diagrams which show an example of the arrangement of each of the units which configure the maintenance unit. FIG. 7 is a diagram which schematically shows the arrangement relationship between the cleaning liquid applying unit 200 and the absorbing member 230 (the wiping unit 240) in particular in the maintenance unit. FIGS. 8A and 8B are diagrams which schematically show the arrangement relationship between the cleaning liquid applying unit 200 and the second capping section 290 in particular in the maintenance unit. FIG. 9 is a diagram which schematically shows the arrangement relationship between the first capping section 260 and the absorbing member 230 (the wiping unit 240) in particular in the maintenance unit.

Below, detailed description will be given of each of the aspects with reference to the drawings. Here, description has been given separately for each of the aspects; however, an arrangement relationship which is obtained by combining each of the aspects may be used.

First Aspect

The cleaning liquid applying unit 200 and the absorbing member 230 (the wiping unit 240) may be arranged to line up in this order along the moving direction according to the moving section 30. In the present specification, the moving direction according to the moving section 30 indicates the relative moving direction of the maintenance unit 20 and the nozzle forming surface 112 as described above, for example, in the example of FIG. 2, both of the right side in the second direction and the left side in the second direction are included.

Specifically, in the example of FIG. 7, the arrangement is in the order of the cleaning liquid applying unit 200 and the absorbing member 230 (the wiping unit 240) from the side close to the recording position along the second direction. In such a case, when the recording heads 110 are moved to the left side in the second direction and the cleaning liquid applying operation and the wiping operation are performed in order, since wasted movement of the recording head 110 is reduced, it is possible to achieve a reduction in the maintenance time.

On the other hand, in a case where the arrangement is in the order of the absorbing member 230 (the wiping unit 240) and the cleaning liquid applying unit 200 from the side close to the recording position along the second direction, after the recording heads 110 are moved temporarily to the left side in the second direction (a position which faces the cleaning liquid applying unit 200), the same effect as in the example of FIG. 7 is obtained when the recording heads 110 are moved to the right and the cleaning liquid applying operation and the wiping operation are performed in order.

Here, in a case where the cleaning liquid applying unit 200 and the absorbing member 230 (the wiping unit 240) are arranged to be adjacent, there are cases where the cleaning liquid flows out to the outside of the cleaning liquid applying unit 200 along with the movement or the like of the recording heads 110. In such a case, the cleaning liquid applying unit 200 is preferably provided with the receptacle 210 for receiving the cleaning liquid which flows out.

In addition, in a case where the cleaning liquid applying unit 200 is provided with the receptacle 210, it is possible for the absorbing member 230 to prevent the leaking due to the cleaning liquid which flows out when the unused absorbing member 230 is arranged so as to pass under the receptacle 210. In addition, it is possible to narrow the arrangement interval between the cleaning liquid applying unit 200 and the absorbing member 230 and it is possible to achieve savings in space. On the other hand, even in a case where the receptacle 210 is not provided, when the used absorbing member 230 is transported to the recording position side (the direction of the arrow A in FIG. 7), since the cleaning liquid is absorbed by the used absorbing member 230, it is possible to suppress the periphery of the cleaning liquid applying unit 200 from being soiled by the cleaning liquid without soiling the unused absorbing member 230.

In a case where the cleaning liquid applying operation, the wiping operation, and the moisturizing operation are performed, a second capping section 290 may be arranged at the right or left side in the moving direction according to the moving section 30, with respect to the cleaning liquid applying unit 200 and the absorbing member 230 (the wiping unit 240). However, the second capping section 290 preferably has the following arrangement relationship. That is, from the point of view of reducing wasted movement of the recording heads 110 and achieving a reduction in the maintenance time, the cleaning liquid applying unit 200, the absorbing member 230 (the wiping unit 240) and the second capping section 290 are preferably arranged to be lined up in this order along the moving direction according to the moving section 30. Specifically, in a case where each of the maintenance operations is performed while moving the recording heads 110 to the left side, the cleaning liquid applying unit 200, the absorbing member 230 (the wiping unit 240), and the second capping section 290 may be arranged in order from the side close to the recording position in FIG. 2. In addition, after the recording heads 110 are temporarily moved to the left end of the maintenance position in the second direction, in a case where each of the maintenance operations are performed by moving in the right direction, the second capping section 290, the absorbing member 230 (the wiping unit 240), and the cleaning liquid applying unit 200 may be arranged in order from the side close to the recording position in FIG. 2.

Second Aspect

The cleaning liquid applying unit 200 and the second capping section 290 may be arranged to be lined up in this order along the moving direction according to the moving section 30.

Specifically, in the example of FIG. 8A, the arrangement is performed in order of the cleaning liquid applying unit 200 and the second capping section 290 from the side close to the recording position along the second direction, and at least the cleaning liquid applying operation is performed by moving the recording heads 110 to the left side in the second direction. In this manner, when the cleaning liquid applying unit 200 and the second capping section 290 are arranged to be adjacent, since it is easy to introduce the cleaning liquid to the inside of the cap member of the second capping section 290 from the cleaning liquid applying unit 200, it is possible to use the cleaning liquid as the moisturizing liquid during the moisturizing operation. In particular, when the second capping section 290 is arranged at the moving direction side of the recording heads 110 to perform the cleaning liquid applying operation as in FIGS. 8A and 8B, it is easier for the cleaning liquid to flow.

In addition, the nozzle forming surface 112, the cleaning liquid applying unit 200, and the second capping section 290 may be provided to be inclined with respect to the horizontal plane. For example, when the recording heads 110 which are arranged to be inclined with respect to the horizontal plane as in FIG. 4B described above are used, the cleaning liquid applying unit 200 and the second capping section 290 are preferably arranged to be inclined with respect to the horizontal plane. In such a case, as shown in FIG. 8B, the cleaning liquid applying unit 200 and the second capping section 290 are more preferably arranged along a surface parallel to the nozzle forming surface 112. Due to this, since it is possible to omit an operation of adjusting the angle of the inclination of the head during the maintenance operation and the angle or the like of inclination of the cleaning liquid applying unit 200 and the second capping section 290, it is possible to achieve a reduction in the maintenance time. Here, the range of "parallel" includes substantially parallel or commonly agreed as parallel.

Furthermore, as shown in FIG. 8B, the cleaning liquid supply port 202 (the cleaning liquid holding surface 204) is preferably arranged at a position higher than the second capping section 290. By doing so, there is an advantage in that the cleaning liquid of the cleaning liquid applying unit 200 flows easily inside the cap member of the second capping section 290.

Here, in a case where the arrangement is in the order of the second capping section 290 and the cleaning liquid applying unit 200 from the side close to the recording position along the second direction, after the recording heads 110 are moved temporarily to the left side in the second direction (a position which faces the cleaning liquid applying unit 200), the same effect as in the example of FIGS. 8A and 8B are obtained when the recording heads 110 are moved to the right and at least the cleaning liquid applying operation is performed.

In the present aspect, as shown in FIGS. 8A and 8B, the absorbing member 230 (the wiping unit 240) may be arranged at a position which is adjacent to the cleaning liquid applying unit 200 or arranged at a position which is adjacent to the second capping section 290. In a preferable arrangement, since there is a concern that deterioration of the liquid repelling film will occur to a large extent when the attachments on the nozzle forming surface 112 are wiped off before the cleaning liquid application, it is preferable that the cleaning liquid applying unit 200, the second capping section 290, and the absorbing member 230 (the wiping unit 240) be arranged in order along the moving direction according to the moving section 30. Specifically, in a case where each of the maintenance operations is performed while moving the recording heads 110 to the left side, the cleaning liquid applying unit 200, the second capping section 290, and the absorbing member 230 (the wiping unit 240) may be arranged in order from the side close to the recording position in FIG. 2. In addition, after the recording heads 110 are temporarily moved to the left end of the maintenance position in the second direction, in a case where each of the maintenance operations are performed by moving the heads in the right direction, the absorbing member 230 (the wiping unit 240), the second capping section 290, and the cleaning liquid applying unit 200 may be arranged in order from the side close to the recording position in FIG. 2. In addition, as shown in FIG. 8B, in the same manner as the cleaning liquid applying unit 200 and the second capping section 290, the absorbing member 230 may also be arranged to be inclined with respect to the horizontal plane.

Third Aspect

In a case where the absorbing member 230 (the wiping unit 240) and the first capping section 260 are provided, the arrangement does not matter. Preferably, the arrangement is lined up in the order of the first capping section 260 and the wiping unit 240 along the moving direction according to the moving section 30.

Specifically, in the example of FIG. 9, the arrangement is in the order of the first capping section 260 and the absorbing member 230 (the wiping unit 240) from the side close to the recording position along the second direction. In such a case, when the recording heads 110 are moved to the left side in the second direction and the suction operation and the wiping operation are performed in order, since it is possible to immediately wipe off the attachments before solidification on the nozzle forming surface 112 which was soiled by the suction operation, it is possible to increase the cleanness of the nozzle forming surface. In addition, it is possible to prevent the contamination of the cleaning liquid applying unit 200. Furthermore, in a case where the wiping operation is performed after the suction operation, due to the absorbing member 230 being contaminated by the ink composition, the absorbing member 230 is moved (for example, moved in the direction of the arrow B in FIG. 9) and the absorbing member 230 which is not soiled may come into contact with the recording heads 110 before the start of the wiping operation after the cleaning is performed by the cleaning liquid applying unit 200. Here, when the moving direction of the absorbing member is the direction of the arrow B, since the cleaning liquid is absorbed by the used absorbing member 230, it is possible to suppress the periphery of the cleaning liquid applying unit 200 from being soiled by the cleaning liquid without soiling the absorbing member 230 before use.

On the other hand, in a case where the arrangement is in the order of the absorbing member 230 (the wiping unit 240) and the first capping section 260 from the side close to the recording position along the second direction, after the recording heads 110 are moved temporarily to the left side in the second direction (a position which faces the first capping section 260) and the suction operation is performed, the same effect as in the example of FIG. 9 is obtained when the recording heads 110 are moved to the right and the wiping operation is performed.

In this aspect, the cleaning liquid applying unit 200 and the second capping section 290 may be arranged at any positions. For example, the cleaning liquid applying unit 200, the absorbing member 230 (the wiping unit 240), and the second capping section 290 are respectively set to the arrangement relationships as shown in the first aspect and the second aspect described above, and it is possible to arrange the absorbing member 230 (the wiping unit 240) and the first capping section 260 as shown in the present aspect.

1.3. Cleaning Solution

It is possible for the cleaning liquid which is used in the ink jet recording apparatus according to the present embodiment to contain at least one type which is selected from an organic solvent, water, and a surfactant.

1.3.1. Organic Solvent

Examples of the organic solvent include glycol ethers, polyhydric alcohols, lactones, pyrrolidone derivatives, organic sulfur compounds, alcohols, ketones, esters, ethers, and the like. These organic solvents may be used alone, or may be used in a mixture of two or more types.

Glycol ethers have favorable permeability with respect to attachments in the same manner as the surfactants which will be described later. Therefore, it is preferable to include at least one surfactant and glycol ether in the cleaning liquid. Examples of the glycol ethers include alkylene glycol monoether, alkylene glycol diether, alkylene glycol mono aryl ether, alkylene glycol monomethyl ether acetate, and the like.

Examples of the alkylene glycol mono ethers include ethylene glycol monomethyl ether, ethylene glycol mono ethyl ether, ethylene glycol mono propyl ether, ethylene glycol mono butyl ether, ethylene glycol mono pentyl ether, ethylene glycol mono hexyl ether, ethylene glycol mono-2-ethyl hexyl ether, propylene glycol mono methyl ether, propylene glycol mono ethyl ether, propylene glycol mono propyl ether, propylene glycol mono butyl ether, propylene glycol mono pentyl ether, propylene glycol mono hexyl ether, propylene glycol mono-2-ethyl hexyl ether, diethylene glycol mono methyl ether, dimethylene glycol mono methyl ether, dimethylene glycol mono ethyl ether, dimethylene glycol mono propyl ether, dimethylene glycol mono butyl ether, dimethylene glycol mono pentyl ether, dimethylene glycol mono hexyl ether, dimethylene glycol mono-2-ethyl hexyl ether, diethylene glycol mono ethyl ether, diethylene glycol mono propyl ether, diethylene glycol mono butyl ether, diethylene glycol mono pentyl ether, diethylene glycol mono hexyl ether, diethylene glycol mono-2-ethyl hexyl ether, dipropylene glycol mono methyl ether, dipropylene glycol mono ethyl ether, dipropylene glycol mono propyl ether, dipropylene glycol mono butyl ether, dipropylene glycol mono pentyl ether, dipropylene glycol mono hexyl ether, dipropylene glycol mono-2-ethyl hexyl ether, trimethylene glycol mono methyl ether, trimethylene glycol mono ethyl ether, trimethylene glycol mono propyl ether, trimethylene glycol mono butyl ether, trimethylene glycol mono pentyl ether, trimethylene glycol mono hexyl ether, trimethylene glycol mono-2-ethyl hexyl ether, triethylene glycol mono methyl ether, triethylene glycol mono ethyl ether, triethylene glycol mono propyl ether, triethylene glycol mono butyl ether, triethylene glycol mono pentyl ether, triethylene glycol mono hexyl ether, triethylene glycol mono-2-ethyl hexyl ether, tri propylene glycol mono methyl ether, tri propylene glycol mono ethyl ether, tri propylene glycol mono propyl ether, tri propylene glycol mono butyl ether, tri propylene glycol mono pentyl ether, tri propylene glycol mono hexyl ether, tri propylene ethyl glycol mono-2-ethyl hexyl ether, and the like.

Examples of the alkylene glycol diethers include ethylene glycol dimethyl ether, ethylene glycol diethyl ether, ethylene glycol dibutyl ether, diethylene glycol dimethyl ether, diethylene glycol diethyl ether, diethylene glycol ethyl methyl ether, diethylene glycol dibutyl ether, triethylene glycol dimethyl ether, triethylene glycol diethyl ether, triethylene glycol dibutyl ether, triethylene glycol butyl methyl ether, tetraethylene glycol dimethyl ether, tetraethylene glycol diethyl ether, tetraethylene glycol dibutyl ether, propylene glycol dimethyl ether, propylene glycol diethyl ether, dipropylene glycol dimethyl ether, dipropylene glycol diethyl ether, and the like.

Examples of the alkylene glycol mono-methyl ether acetate include ethylene glycol mono methyl ether acetate, ethylene glycol mono ethyl ether acetate, ethylene glycol mono propyl ether acetate, ethylene glycol mono butyl ether acetate, propylene glycol mono methyl ether acetate, propylene glycol mono ethyl ether acetate, propylene glycol mono propyl ether acetate, propylene glycol mono butyl ether acetate, dimethylene glycol mono methyl ether acetate, dimethylene glycol mono ethyl ether acetate, dimethylene glycol mono propyl ether acetate, dimethylene glycol mono butyl ether acetate, diethylene glycol mono methyl ether acetate, diethylene glycol mono ethyl ether acetate, diethylene glycol mono propyl ether acetate, diethylene glycol mono butyl ether acetate, dipropylene glycol mono methyl ether acetate, dipropylene glycol mono ethyl ether acetate, dipropylene glycol mono propyl ether acetate, dipropylene glycol mono butyl ether acetate, trimethylene glycol mono methyl ether acetate, trimethylene glycol mono ethyl ether acetate, trimethylene glycol mono propyl ether acetate, trimethylene glycol mono butyl ether acetate, triethylene glycol mono methyl ether acetate, triethylene glycol mono ethyl ether acetate, triethylene glycol mono propyl ether acetate, triethylene glycol mono butyl ether acetate, tri propylene glycol mono methyl ether acetate, tri propylene glycol mono ethyl ether acetate, tri propylene glycol mono propyl ether acetate, tri propylene glycol mono butyl ether acetate, 3-methoxy butyl acetate, 3-methoxy-3-methyl-1-butyl acetate, and the like.

Examples of the alkylene glycol mono aryl ethers include dimethylene glycol mono phenyl ether, dimethylene glycol mono benzyl ether, dimethylene glycol mono tolyl ether, trimethylene glycol mono phenyl ether, trimethylene glycol mono benzyl ether, trimethylene glycol mono tolyl ether, ethylene glycol mono phenyl ether, ethylene glycol mono benzyl ether, ethylene glycol mono tolyl ether, diethylene glycol mono phenyl ether, diethylene glycol mono benzyl ether, diethylene glycol mono tolyl ether, triethylene glycol mono phenyl ether, triethylene glycol mono benzyl ether, triethylene glycol mono tolyl ether, propylene glycol mono phenyl ether, propylene glycol mono benzyl ether, propylene glycol mono tolyl ether, dipropylene glycol mono phenyl ether, dipropylene glycol mono benzyl ether, dipropylene glycol mono tolyl ether, tri propylene glycol mono phenyl ether, tri propylene glycol mono benzyl ether, tri propylene glycol mono tolyl ether, and the like.

Examples of the polyhydric alcohols include glycerin, 1,2,6-hexane triol, trimethylol propane, pentamethylene glycol, trimethylene glycol, ethylene glycol, propylene glycol, diethylene glycol, triethylene glycol, tetraethylene glycol, pentaethylene glycol, polyethylene glycol with an average molecular weight of 2000 or less, dipropylene glycol, tri propylene glycol, iso-butylene glycol, 2-butene-1, 4-diol, 2-ethyl-1, 3-hexanediol, 2-methyl-2, 4-pentanediol, meso-erythritol, pentaerythritol, 1,2-pentanediol, 1,2-hexanediol, 1,3-propanediol, 1,4-butanediol, 1,5-pentanediol, 1,6-hexanediol, 1,7-heptanediol, 1,8-octanediol and the like.

Examples of the lactones include β-propiolactone, β-butyrolactone, γ-butyrolactone, γ-valerolactone, and ϵ-caprolactone.

Examples of the pyrrolidone derivatives include N-methyl-2-pyrrolidone, N-ethyl-2-pyrrolidone, N-vinyl-2-pyrrolidone, 2-pyrrolidone, N-butyl-2-pyrrolidone, 5-methyl-2-pyrrolidone, and the like.

Examples of the organic sulfur compounds include dimethyl sulfoxide, dimethyl sulfone, sulfolane, and the like.

It is possible for the content of the organic solvent to be appropriately determined according to the physical properties of the cleaning liquid which will be described later and the type of the ink composition to be used.

1.3.2. Surfactant

It is possible to use a surfactant from the point of view of increasing the cleanness by increasing the permeability with respect to the ink attachments. Such surfactants are not particularly limited; however, examples include silicon-based surfactants, fluorine-based surfactants, anionic surfactants, or polyoxyethylene derivatives or the like which are non-ionic surfactants.

1.3.3. Water

The cleaning liquid according to the present embodiment preferably contains water. Due to this, it is possible to wet and spread the ink composition favorably on the nozzle forming surface or the liquid repelling film. It is possible for the content of the water to be appropriately determined according to the physical properties of the cleaning liquid which will be described later and the type of the ink composition to be used; however, from the point of view of the wetting and spreading of the ink composition, 30 mass % or more, more preferably 50 mass % or more may be included.

1.3.4. Other Components

The cleaning liquid which is used in the ink jet recording apparatus according to the present embodiment may further contain a preservative, an antifungal agent, a pH adjusting agent, a rust inhibitor, a chelating agent, or the like.

1.3.5. Physical Properties of Cleaning Liquid

For the cleaning liquid which is used in the ink jet recording apparatus according to the present embodiment, from the point of view of easy wetting, spreading and forming of the liquid film when being attached to the nozzle forming surface and from the point of view of permeability regarding the attachments which are attached to the nozzle forming surface, the surface tension at 20° C. is preferably 20 mN/m or more to 45 mN/m or less, more preferably 22.5 mN/m or more to 40 mN/m or less, and even more preferably 22.5 mN/m or more to 35 mN/m or less. Here, it is possible to measure the surface tension by confirming the surface tension when wetting a platinum plate with ink in an environment of 20° C. using an automatic surface tension meter CBVP-Z (trade name, manufactured by Kyowa Interface Science Co., Ltd.).

1.4. Ink Composition

The ink jet recording apparatus according to the present embodiment is not particularly limited as long as there are nozzles which discharge an ink composition which contains an inorganic pigment (also referred to below as an "inorganic pigment containing ink composition") and may further have nozzles which discharge an ink composition which does not contain an inorganic pigment (also referred to below as a "non-inorganic pigment containing ink composition"). Below, description will be given of the additives (the components) which are included or able to be included in the inorganic pigment containing ink composition and the non-inorganic pigment containing ink composition of the present embodiment (the inorganic pigment containing ink composition and the non-inorganic pigment containing ink composition are referred to below simply as "ink compositions").

1.4.1. Color Material

The inorganic pigment containing ink composition of the present embodiment is not particularly limited as long as an inorganic pigment is included. In addition, the non-inorganic pigment containing ink composition may include a coloring material and the coloring material is selected from pigments and dyes other than inorganic pigments.

The inorganic pigments are not particularly limited; however, examples include carbon black, iron oxide, titanium oxide, silica oxide, and the like.

Here, the inorganic pigment which is included in the inorganic pigment containing ink composition preferably has an average particle diameter of 200 nm or more and more preferably 250 nm or more. In addition, the upper limit of the average particle diameter is preferably 4 μm or less, and more preferably 2 μm or less. Furthermore, the Mohs hardness of the inorganic pigments is preferably more than 2.0 and more preferably 5 or more. In addition, the upper limit of the hardness is preferably 8 or less. The inorganic pigments in the ranges described above damage the liquid repelling film comparatively easily and impair the storability of the liquid repelling film in ordinary ink jet recording apparatuses; however, with the ink jet recording apparatus of the present embodiment, even in a case where the inorganic pigments are used in the ranges described above, the storability of the liquid repelling film is favorable due to having the configuration described above. In addition, the Mohs hardness of the organic pigments is normally 1 or less and there is little concern that the storability of the liquid repelling film will be impaired in comparison with the inorganic pigments.

In addition, the acicular ratio of the inorganic pigments is preferably 3.0 or less. By setting such an acicular ratio, it is possible for the invention to favorably protect the liquid repelling film. The acicular ratio is a value obtained by dividing the maximum length of each of the particles by the minimum width (the acicular ratio=the maximum length of the particles/the minimum width of the particles). It is possible to measure a specific acicular ratio using a transmission electron microscope. Here, that the acicular ratio of the inorganic pigments is 3.0 or less does not indicate a case where all of the inorganic pigments satisfy this value.

The inorganic pigment containing ink composition preferably includes 20 mass % or less of inorganic pigments. In particular, in a case where the inorganic pigment containing ink composition is a white ink composition, the inorganic pigment density is preferably 5 mass % or more. In the ranges described above, the desired characteristics of the inorganic pigment ink are maintained, and with the ink jet recording apparatus of the present embodiment, the storability of the liquid repelling film is preserved.

The Mohs hardness is measured using the Mohs scale. The Mohs scale was devised by F. Mohs and 10 types of minerals from a soft mineral to a harder mineral are housed in a box and the degree of hardness is given in order as 1, 2, . . . 10 starting from the soft material. The reference minerals are as follows (the numbers indicate the hardness). 1: talc, 2: gypsum, 3: calcite, 4: fluorite, 5: apatite, 6: orthoclase feldspar, 7: quartz, 8: topaz, 9: corundum, 10: diamond. When the surface of a mineral sample whose hardness is to be determined is damaged by scratching with these minerals, it is possible to compare the hardnesses from the forces which resist the damage (whether or not there is damage). For example, when calcite is damaged, the hardness of the sample is greater than 3. When damaged by fluorite while the fluorite is not damaged, the hardness of the sample is less than four. At this time, the hardness of the sample is indicated as 3 to 4, or 3.5. When both are somewhat scratched by each other, the hardness of the sample is indicated with the same number as the reference mineral which is used. The hardness of the Mohs scale is just a degree and not an absolute value.

Inorganic pigments which satisfy a Mohs hardness of more than 2.0 are not particularly limited; however, examples include single metals such as gold, silver, copper, aluminum, nickel, and zinc; oxides such ascerium oxide, chromium oxide, aluminum oxide, zinc oxide, magnesium oxide, silicon oxide, tin oxide, zirconium oxide, iron oxide, and titanium oxide; sulfates such as calcium sulfate, barium sulfate, and aluminum sulfate; silicates such as calcium silicate and magnesium silicate; nitrides such as boron nitride and titanium nitride; carbides such as silicon carbide, titanium carbide, boron carbide, tungsten carbide, and zirconium carbide; borides such as zirconium boride and titanium boride; and the like. Examples of preferable inorganic pigments out of these include aluminum, aluminum oxide, titanium oxide, zinc oxide, zirconium oxide, silicon oxide, and the like. More preferable examples include titanium oxide, silicon oxide, aluminum oxide, and the like. In the titanium oxides, rutile oxides have a Mohs hardness of approximately 7 to 7.5 while anatase oxides are approximately 6 to 6.6. Rutile titanium oxide has low manufacturing costs and preferable crystallinity, and is able to exhibit favorable whiteness. Therefore, in a case where rutile titanium dioxide is used, the liquid repelling film has storability, and the ink jet recording apparatus is able to prepare print material with favorable whiteness at low cost.

Examples of white inorganic pigments include alkaline earth metal sulfates such as barium sulfate, alkaline earth metal carbonates such as calcium carbonate, silicas such as fine silicic acid or synthetic silicate, calcium silicate, metal compounds such as alumina, alumina hydrate, titanium oxide, and zinc oxide, in addition to talc, clay, and the like. In particular, titanium oxide is known as a white pigment with a preferable masking property, coloring property, and dispersion particle diameter.

The organic pigments are not particularly limited; however, examples include quinacridone pigments, quinacridonequinone pigments, dioxazine pigments, phthalocyanine pigments, anthrapyrimidine pigments, anthanthrone pigments, indanthrone pigments, flavanthrone pigments, perylene pigments, diketopyrrolopyrrole pigments, perynone pigments, quinophthalone pigments, anthraquinone pigments, thioindigo pigments, benzimidazolone pigments, isoindoline pigments, azomethine pigments, azo pigments, and the like. Specific examples of the organic pigments include the following.

The average particle diameter of the pigments other than the inorganic pigments is preferably 250 nm or less in order for it to be possible to suppress clogging in the nozzles and to achieve more favorable discharge stability. Here, the average particle diameter in the present specification is based on volume. The measuring method, for example, is able to perform measuring using a particle size distribution measuring apparatus using laser diffraction scattering as the measuring principle. Examples of the particle size distribution measuring apparatus include a particle size distribution meter (for example, Micro track UPA manufactured by Nikkiso Co., Ltd.) using a dynamic light scattering method as the measuring principle.

In the present embodiment, it is possible to use a dye as the coloring material. The dyes are not particularly limited and it is possible to use acid dyes, direct dyes, reactive dyes, and basic dyes.

The content of the coloring material is preferably 0.4 to 12 mass % with respect to the total weight (100 mass %) of the ink composition, and more preferably 2 to 5 mass %.

1.4.2. Resin

Inks which are suitable for use in the ink jet recording apparatus of the embodiment described above and which contain inorganic pigments preferably have one of the following characteristics (1) or (2) in terms of composition.

(1) The ink jet recording ink composition includes a first resin with a heat distortion temperature of 10° C. or less (referred to below as the "first ink").

(2) The ink jet recording ink composition includes a second resin and substantially does not contain glycerin and (referred to below as the "second ink").

These ink compositions have a property of easily solidifying on the nozzle forming surface and absorbing member and a tendency to easily cause damage to the liquid repelling film; however, the invention is able to favorably prevent this.

The first ink described above includes the first resin with a heat distortion temperature of 10° C. or less. Such resins have a property of firmly adhering with respect to materials which are highly flexible and absorbent, such as fabrics.

On the other hand, the process of becoming a film and solidifying proceed rapidly and the resins are attached as solid matter to the nozzle forming surface, the absorbing material or the like.

The second ink described above substantially does not include glycerine with a boiling point of 290° C. at one atmosphere. When the colored ink substantially includes glycerine, the drying property of the ink is greatly decreased. As a result, in various recording media, in particular, recording media which do not absorb ink or which have low ink absorbency, not only did the uneven light and shade of the image stand out, but it was not possible to obtain the fixing property of the ink. In addition, by not including glycerine, the moisture or the like which is the main solvent in the ink evaporates rapidly and the proportion of the organic solvent increases in the second ink. In such a case, as a result of the heat distortion temperature of the resin (in particular, the film forming temperature) being lowered, solidification is further promoted due to the film. Furthermore, alkyl polyols (excluding glycerine described above) with a boiling point of 280° C. or higher at one atmosphere equivalent are preferably substantially not included. In addition, in the case of the second ink, with a recording apparatus which has a heating mechanism which heats a recording medium which is transported to a position which faces the recording heads, the drying of the ink in the vicinity of the recording heads is accelerated and the problem becomes more significant; however, it is possible to prevent this with the invention, which is favorable. When the temperature of the heating is 30° C. or higher to 80° C. or less, this is preferable from the point of view of the storage stability of the ink and the recording image quality. The heating mechanism is not particularly limited, and examples include a heat generating heater, a hot air heater, an infrared heater, and the like.

Here, "substantially does not include" in the present specification has the meaning that an amount or more which is sufficient to exhibit significance when added is not contained. In terms of quantities, with respect to the total weight (100 mass %) of the color inks, 1.0 mass % or more of glycerine is preferably not included, more preferably 0.5 mass % or more is not included, even more preferably 0.1 mass % or more is not included, yet more preferably 0.05 mass % or more is not included, particularly preferably 0.01 mass % or more is not included, and most preferably 0.001 mass % or more is not included.

The heat distortion temperature of the first resin is 10° C. or less. Furthermore, −10° C. or less is preferable, and −15° C. or less is more preferable. In a case where the glass transition temperature of the fixing resin is in the range described above, the fixing property of the pigment in the recorded matter is superior and the abrasion resistance is excellent as a result. Here, the lower limit of the heat distortion temperature is not particularly limited; however, the temperature may be −50° C. or higher.

For the heat distortion temperature of the second resin, the lower limit is preferably 40° C. or higher and more preferably 60° C. or higher since the head clogging does not easily occur and it is possible to have favorable abrasion resistance in the recorded matter. The upper limit is preferably 100° C. or less.

Here, in the present specification, the "heat distortion temperature" is a temperature value which is represented by the glass transition temperature (Tg) or the minimum film-forming temperature (MFT). That is, "the heat distortion temperature is 40° or higher" has the meaning that either of Tg or MFT may be 40° C. or higher. In addition, since it is easier to grasp the superiority or inferiority of the re-dispersibility of the resin with MFT than with Tg, the heat distortion temperature is preferably a temperature value which is represented by MFT. With an ink composition which is excellent in the re-dispersibility of the resin, the heads are not easily clogged since the ink composition is not fixed.

Tg in the present specification describes a value which is measured by differential scanning calorimetry. In addition, MFT in the present specification describes a value which is measured by ISO 2115:1996 (title:Measurement of white point temperature and minimum film-forming temperature in plastic polymer dispersions).

The resin described above is not particularly limited; however, examples include (meth)acrylic polymers such as poly(meth)acrylic acid esters or copolymers thereof, polyacrylonitrile or copolymers thereof, polycyanoacrylate, polyacrylamide, and poly(meth)acrylic acid; polyolefin polymers such as polyethylene, polypropylene, polybutene, polyisobutylene, and polystyrene, and copolymers thereof, petroleum resins, coumarone-indene resins, and terpene resins; vinyl acetate or vinyl alcohol polymers such as polyvinyl acetate or copolymers thereof, polyvinyl alcohols, polyvinyl acetals, and polyvinyl ethers; halogen-containing polymers such as polyvinyl chloride or copolymers thereof, polyvinylidene chloride, fluorine resin, and fluorine rubber; nitrogen-containing vinyl polymers such as polyvinyl carbazole, polyvinylpyrrolidone or copolymers thereof, polyvinyl pyridine, and polyvinyl imidazole; diene polymers such as polybutadiene or copolymers thereof, polychloroprene, and polyisoprene (butyl rubber); other ring-opening polymerized resins, condensation polymerization type resins, natural polymer resins, and the like.

Examples of commercial products of the resins described above include High Tech E-7025 P, High Tech E-2213, High Tech E-9460, High Tech E-9015, High Tech E-4 A, High Tech E-5403 P, High Tech E-8237 (the above are all trade names manufactured by TOHO Chemical Industry Co., Ltd.), AQUACER 507, AQUACER 515, AQUACER 840, (the above are all trade names manufactured by BYK Co., Ltd.), JONCRYL 67, 611, 678, 680, and 690 (the above are all trade names manufactured by BASF Co., Ltd.), and the like.

The resins may be any of anionic, non-ionic, or cationic. Among these, from the point of view of materials suited for the heads, non-ionic or anionic are preferable. The resin may be used alone as one type or may be combined and used as two or more types.

The content of the resin is preferably 1 to 30 mass % with respect to the total weight (100 mass %) of the ink composition, more preferably 1 to 5 mass %. In a case where the content is within the range described above, it is possible for the glossiness and the abrasion resistance of the topcoat image to be formed to be superior.

In addition, examples of the resins which may be contained in the ink composition described above include a resin dispersing agent, a resin emulsion, wax, and the like.

Among these, with an emulsion, the adhesion and abrasion resistance are favorable, which is preferable.

When the pigments described above are contained in the ink composition of the present embodiment, the ink composition may include a resin dispersing agent in order for it to be possible to stably disperse and hold the pigments in water. By including a pigment (referred to below as a "resin dispersion pigment") which is dispersed using a resin dispersing agent such as a water-dispersible resin or a water-soluble resin in the ink composition described above, it is possible to obtain favorable adhesion in at least one of between the target recording medium and the ink composition or between the solid matter in the ink composition when the ink composition is attached to the target recording medium. Since the dispersion stability in the resin dispersing agent is excellent, a water-soluble resin is preferable.

The ink composition of the present embodiment preferably includes a resin emulsion. By forming a resin film, the resin emulsion exhibits an effect of sufficiently fixing the ink composition to the target recording medium and making the abrasion resistance of the image favorable. Due to the effect described above, recorded matter which is recorded by using an ink composition which contains a resin emulsion has excellent adhesion and abrasion resistance on a target recording medium which does not absorb ink or which has low absorbency, in particular, fabric. On the other hand, there is a tendency to promote the solidification of the inorganic pigments; however, it is possible to favorably prevent the problems which occur due to the solidification in the invention.

In addition, a resin emulsion which functions as a binder is preferably contained in the ink composition in an emulsion state. By the resin which functions as a binder being contained in the ink composition in an emulsion state, it is easy to adjust the viscosity of the ink composition into an appropriate range in an ink jet recording system and the storage stability and the discharge stability of the ink composition are excellent.

The resin emulsion is not particularly limited; however, examples include (meth)acrylic acid, (meth)acrylic acid ester, acrylonitrile, cyanoacrylate, acrylamide, olefin, styrene, vinyl acetate, vinyl chloride, vinyl alcohol, vinyl ether, vinyl pyrrolidone, vinyl pyridine, vinyl carbazole, vinyl imidazole, a homopolymer or copolymer of vinylidene chloride, fluorine resins, natural resins, and the like. Among these, at least one of a (meth)acrylic resin and a styrene (meth)acrylic acid copolymer resin is preferable, at least one of an acrylic resin and a styrene acrylic acid copolymer resin is more preferable, and a styrene acrylic acid copolymer resin is even more preferable. Here, the copolymers described above may be in the form of any of random copolymers, block copolymers, alternating copolymers, and graft copolymers.

A commercially available product may be used as the resin emulsion, which may be prepared using the following emulsion polymerization method. Examples of the method of obtaining the resin in the ink composition in a state of emulsion include emulsion-polymerizing a monomer of the water-soluble resin described above in water in which a polymerization catalyst and emulsifier are present. It is possible for the polymerization initiators, the emulsifiers, and the molecular weight adjusting agents which are used in the emulsion polymerization to be used in accordance with well-known methods in the related art.

The average particle diameter of the resin emulsion is preferably in the range of 5 nm to 400 nm and more preferably in the range of 20 nm to 300 nm in order to further improve the storage stability and the discharge stability of the ink.

The resin emulsion may be used alone as one type or may be combined and used as two or more types. The content of the resin emulsion in the resin is preferably in a range of 0.5 to 15 mass % with respect to the total weight (100 mass %) of the ink composition. When the content is within the range described above, since it is possible to lower the solid concentration, it is possible to further improve the discharge stability.

The ink composition of the present embodiment may include wax. By the ink composition including wax, the ink composition has a superior fixing property onto target recording media which do not absorb ink or which have low absorbency. Among the waxes, emulsion or suspension type waxes are more preferable. The waxes described above are not particularly limited; however, examples include polyethylene wax, paraffin wax, polypropylene wax and the like, among which polyethylene wax, which will be described later, is preferable.

By the ink composition described above including polyethylene wax, it is possible for the abrasion resistance in the ink to be excellent.

The average particle diameter of the polyethylene wax is preferably in a range of 5 nm to 400 nm and more preferably in a range of 50 nm to 200 nm in order to further improve the storage stability and the discharge stability of the ink.

The content of polyethylene wax (in terms of solid content) is preferably in a range of 0.1 to 3 mass % with respect to the total weight (100 mass %) of the ink composition, more preferably in a range of 0.3 to 3 mass %, and even more preferably in a range of 0.3 to 1.5 mass %. When the content is within the ranges described above, it is possible to favorably solidify and fix the ink composition on the target recording medium and the storage stability and the discharge stability of the ink are superior.

1.4.3. Anti-foaming Agent

The ink composition of the present embodiment may include an anti-foaming agent. In more detail, at least one of the ink composition or the cleaning liquid of the present embodiment preferably includes an anti-foaming agent. In a case where the ink composition includes an anti-foaming agent, it is possible to prevent foaming and, as a result, it is possible to prevent the problem of bubbles entering the nozzles.

The anti-foaming agent described above is not particularly limited; however, examples include silicon-based anti-foaming agents, polyether-based anti-foaming agents, fatty acid ester-based anti-foaming agents, acetylene glycol-based anti-foaming agents, and the like. Among these, since the ability to properly retain the surface tension and the interfacial tension is excellent and bubble are hardly caused, silicon-based anti-foaming agents, and acetylene glycol-based anti-foaming agents are preferable. In addition, the HLB value is preferably 5 or less based on the Griffin method for anti-foaming agents.

1.4.4. Surfactant

The ink composition of the present embodiment may include a surfactant (excluding the anti-foaming agents described above, that is, limited to surfactants with an HLB value of greater than 5 according to the Griffin method). The surfactant is not particularly limited; however, examples include non-ionic surfactants. Non-ionic surfactants have an effect of uniformly spreading the ink on the recording medium. Therefore, in a case where the ink jet recording is performed using an ink which includes a non-ionic surfactant, it is possible to obtain a high-definition image with little bleeding. The non-ionic surfactant is not particularly limited; however, examples include silicon-based surfactants, polyoxyethylene alkyl ether-based surfactants, polyoxypropylene alkyl ether-based surfactants, polycyclic phenyl ether-based surfactants, sorbitan derivatives, fluorine-based surfactants, and the like, among which silicon-based surfactants are preferable.

In comparison with other non-ionic surfactants, the silicon-based surfactants have an excellent effect of spreading the ink uniformly such that bleeding is not caused on the target recording medium.

The silicon-based surfactant is not particularly limited; however, examples preferably include polysiloxane-based compounds. The polysiloxane-based compound is not particularly limited; however, examples include polyether-modified organosiloxane. Commercially available products of the polyether-modified organosiloxane are not particularly limited; however, examples include BYK-306, BYK-307, BYK-333, BYK-341, BYK-345, BYK-346, BYK-348, and BYK-349 (the above are trade names manufactured by BYK Co., Ltd), KF-351 A, KF-352 A, KF-353, KF-354 L, KF-355 A, KF-615 A, KF-945, KF-640, KF-642, KF-643, KF-6020, X-22-4515, KF-6011, KF-6012, KF-6015, KF-6017 (the above are trade names, manufactured by Shin-Etsu Chemical Co., Ltd.), and the like.

The surfactants may be used alone as one type or may be mixed and used as two or more types. The content of the surfactant is preferably in a range of 0.1 mass % or more and 3 mass % or less with respect to the total weight of the ink (100 mass %) in order to improve the storage stability and the discharge stability of the ink.

1.4.4. Water

The ink composition of the present embodiment may contain water. In particular, in a case where the ink is a water-based ink, water is the main medium of the ink, and is a component which evaporates and scatters when the target recording medium is heated in the ink jet recording. Description of the water will be omitted since it is possible to use the same examples given for the cleaning liquid. The content of the water is not particularly limited, and may be appropriately determined according to necessity.

1.4.4. Organic Solvent

The ink composition of the present embodiment may contain an organic solvent. Description of the organic solvent will be omitted since it is possible to give the same examples as for the components illustrated in the cleaning liquid described above.

The organic solvents may be used alone as one type or may be combined and used as two or more types. The content of the organic solvent is not particularly limited, and may be appropriately determined according to necessity.

1.4.5. Other Components

The ink composition according to the present embodiment may further contain a pH adjusting agent, a preservative, an antifungal agent, a rust inhibitor, a chelating agent, or the like. Description of these components will be omitted since it is possible to give the same examples as for the components illustrated in the cleaning liquid described above.

1.4.6. Preparation Method of Ink Composition

It is possible to obtain the ink composition of the present embodiment by mixing the components (materials) described above in an arbitrary order, performing filtration or the like as necessary, and removing impurities. Here, it is preferable for the pigment to be prepared in a state of being uniformly dispersed in the solvent in advance and mixed because the handling is simplified. As the mixing method of each of the materials, it is possible to appropriately use a method of adding, stirring, and mixing the materials in sequence in a container which is provided with a stirring apparatus such as a mechanical stirrer or a magnetic stirrer. As the filtration method, for example, it is possible to perform centrifugal filtration or filter filtration as necessary.

1.4.7. Physical Properties of Ink Composition

The surface tension of the ink composition according to the present embodiment is not particularly limited; however, 15 to 35 mN/m is preferable. Due to this, it is possible to secure the permeation of the ink composition into the absorbing member and the bleeding prevention property during recording, and the wipability of the ink during the cleaning operation is improved. It is possible to illustrate a method of measuring the surface tension of the ink composition using a commonly used surface tensiometer (for example, a surface tensiometer CBVP-Z, or the like manufactured by Kyowa Interface Science Co., Ltd.). In addition, the differences in the surface tension of the ink composition and the surface tension of the cleaning liquid preferably have a relationship of within 10 mN/m. Due to this, it is possible to prevent the surface tension of the ink composition from greatly decreasing when both are mixed in the vicinity of the nozzles.

2. Experiment Examples

Below, embodiments of the invention will be specifically described using experiment examples; however, the present embodiment is not limited to only these experiment examples.

2.1. Ink Composition 2.1.1. Material of Ink Composition

The main materials for the ink compositions used in the following experiment examples are as follows.

Coloring Material
- Carbon Black (C.I. Pigment Black 7, average particle diameter 100 nm, Mohs hardness 1-2)
- C.I. Pigment Blue 15:3 (average particle diameter 100 nm, Mohs hardness 1 or less)
- C.I. Pigment Red 122 (average particle diameter 120 nm, Mohs hardness 1 or less)
- C.I. Pigment yellow 155 (average particle diameter 200 nm, Mohs hardness 1 or less)
- Titanium dioxide (average particle diameter 350 nm, Mohs hardness 7.2)

Organic Solvent
- 1,2-hexanediol
- 2-pyrrolidone
- Triethylene glycol monobutyl ether
- Glycerine
- Propylene glycol Resin
- Styrene acrylic acid copolymer resin emulsion (Tg 85° C., average particle diameter 140 nm)
- Anionic urethane resin emulsion (Tg −20° C., acid value 25 or less, average particle diameter 100 nm)
- Polyethylene wax emulsion (trade name "AQUACER 515" manufactured by BYK Co., Ltd.)

Surfactant
- Silicon-based surfactant (trade name "BYK 348" manufactured by BYK Co., Ltd.)

Anti-Foaming Agent
- Acetylene glycol based anti-foaming agent (trade name "Surfynol DF 110 D", manufactured by Nissin Chemical Industry Co., Ltd., HLB value=3)

pH Adjusting Agent
- Triethanolamine

Water
- Pure water

The average particle diameter described above was measured in compliance with "Microtrac UPA" which is a trade name of Nikkiso Co., Ltd. In addition, the Tg described above was measured with dried matter of the emulsion as a sample using "DSC-6200R" which is a trade name manufactured by SII Nano Technologies Inc.

2.1.2. Preparation of Pigment Dispersion for Ink Composition 40 parts by mass of water-soluble resin (resin copolymerized with a weight ratio of methacrylic acid/butyl acrylate/styrene/hydroxyethyl acrylate=25/50/15/10 and with a weight average molecular weight of 12,000) were introduced into a liquid where 7 parts by mass of potassium hydroxide, 23 parts by mass of water, and 30 parts by mass of triethylene glycol-mono-n-butyl ether were mixed, and an aqueous resin solution was prepared by heating while stirring at 80° C.

3.0 kg of coloring materials and 10.25 kg of water were each blended with 1.75 kg of the aqueous resin solution (solid content 43%), pre-mixing was performed by stirring in a mixing stirrer, and a mixed solution was obtained. The mixed solution described above was dispersed with a multi-pass system using a horizontal type bead mill which was provided with a multi-disc-type impeller which had an effective volume of 1.5 liters filled with 85% 0.5 mm zirconia beads. Specifically, two passes were performed with a discharge amount of 30 liters per hour and with a bead peripheral speed of 8 m/s, and a pigment dispersion mixed solution with an average particle diameter of 325 nm was obtained. Next, circulation dispersion of the pigment dispersion mixed solution described above was performed using a horizontal type annular bead mill which had an effective volume of 1.5 liters filled with 95% 0.05 mm zirconia beads. A dispersion process is performed for four hours using a 1.5 mm screen with a bead peripheral speed of 10 m/s on 10 kg of the pigment dispersion mixed solution with a circulation amount of 300 liters/hour, and an aqueous pigment dispersion solution with 20% coloring material solid content and 5% aqueous resin was obtained.

2.1.3. Preparation of Ink Composition

The pigment dispersion solution which was prepared as described above was prepared in an amount such that the coloring material was 2.5 mass % (4 mass % for Bk 2). In this pigment dispersion solution, each of the components other than the coloring material shown in the following Table 1 was added to be the contents (units: mass %) described in the following Table 1, and the inorganic pigment containing ink compositions (Bk 1, Bk 2, and W) and the non-inorganic pigment containing ink compositions (C, M, and Y) were prepared (total 100.0 mass %). Each of the ink compositions was prepared by removing foreign matter (impurities) such as dust, coarse particles, or the like by filtration with a membrane filter with a hole diameter of 5 μm after each of the components was placed into a container and stirred and mixed for two hours with a magnetic stirrer. Here, for the water-soluble resin, an amount which was equivalent to one part in four of the content of each of the coloring materials was added to the ink.

TABLE 1

| Material Type | Material Name | Bk 1 | C | M | Y | W | Bk 2 |
|---|---|---|---|---|---|---|---|
| Pigment | Carbon black | 2.5 | | | | | 4 |
| | Pigment blue 15:3 | | 2.5 | | | | |
| | Pigment red 122 | | | 2.5 | | | |
| | Pigment yellow 155 | | | | 2.5 | | |
| | Titanium dioxide | | | | | 10 | |
| Organic Solvent | 1,2-hexanediol | 5 | 5 | 5 | 5 | 5 | 5 |
| | 2-pyrrolidone | 15 | 15 | 15 | 15 | 15 | 5 |
| | Triethylene glycol mono butyl ether | | | | | | 3 |
| | Glycerine | | | | | | 10 |
| | Propylene glycol | 10 | 10 | 10 | 10 | 10 | 10 |
| Resin | Styrene acrylic acid resin emulsion | 1 | 1 | 1 | 1 | 1 | |
| | Urethane resin emulsion | | | | | | 6 |
| | Polyethylene wax emulsion | 0.5 | 0.5 | 0.5 | 0.5 | 0.5 | |
| Surfactant | Silicon-based surfactant | 0.5 | 0.5 | 0.5 | 0.5 | 0.5 | 1 |
| Anti-foaming agent | Acetylene glycol based anti-foaming agent | 0.2 | 0.2 | 0.2 | 0.2 | 0.2 | 0.2 |
| pH adjusting agent | Triethanolamine | 0.2 | 0.2 | 0.2 | 0.2 | 0.2 | 0.2 |
| Water | Pure water | Residue | Residue | Residue | Residue | Residue | Residue |
| Total (mass %) | | 100 | 100 | 100 | 100 | 100 | 100 |

2.2. Cleaning Solution 2.2.1. Material of Cleaning Solution

The main materials of the cleaning liquid which were used in the following examples are as follows.

Surfactant

Acetylene glycol-based surfactant (trade name "Olfine E 1010", manufactured by Nissin Chemical Industry Co., Ltd.)

Organic Solvent

Triethylene glycol monobutyl ether

Polyethylene glycol (weight average molecular weight 200)

Water

Pure water 2.2.2. Preparation of Cleaning Liquid

Each of the components shown in the following Table 2 was added to be the contents (units: mass %) described in the following Table 2 and the cleaning liquid was prepared (total 100.0 mass %). The cleaning liquid was prepared by removing impurities such as dust, coarse particles, or the like by filtration with a membrane filter with a hole diameter of 5 μm after each of the components was placed into a container and stirred and mixed for two hours with a magnetic stirrer.

TABLE 2

| Material Type | Material Name | Cleaning Liquid |
|---|---|---|
| Surfactant | Acetylene glycol-based surfactant | 5 |
| Organic solvent | Triethylene glycol monobutyl ether | 5 |
| | Polyethylene glycol | 30 |
| Other | Pure water | 60 |
| Total (mass %) | | 100 |

2.3. Ink Jet Recording

A modified printer PX-H10000 (manufactured by Seiko Epson Corporation) was used (referred to below as the modified PX—H10000"). The modified portion has the feature of being provided with a print head provided with a silicon nozzle plate with an attached liquid repelling film and the nozzle plate cover shown in FIG. 10, the absorbing member (the wiping unit), the moving section, and the cleaning liquid applying unit as shown in FIG. 1, FIG. 5, and FIGS. 6A and 6B, and a heating mechanism which heats the recording medium during recording.

A silicon nozzle plate which was formed of single crystal silicon was used. On the nozzle forming surface, a silicon oxide film ($SiO_2$ film) which was film formed by a chemical vapor deposition method was formed by introducing $SiCl_4$ and steam into a chemical vapor deposition (CVD) reactor. The film thickness of the $SiO_2$ film was 50 nm. Furthermore, after an oxygen plasma process was performed, a liquid repelling film (thickness 10 nm) was formed on the $SiO_2$ film by performing chemical vapor deposition (CVD) using $C_8F_{17}C_2H_4SiCl_3$, and the silicon nozzle plate with the attached liquid repelling film was manufactured.

As the absorbing member, cupra non-woven fabric [density 0.01 (g/cm$^2$), cloth thickness 0.4 mm] was used. As the elastic member, a roller with a Shore A hardness of 30 was used. The measurement of the Shore A hardness was performed in compliance with a measurement method defined in ATSM D-2240 where the outer layer of a foam formed roller or a sheet shaped sample was prepared by press forming a thermoplastic elastomer at a temperature of 200° C. before foam forming and the sheet shaped sample was measured. In addition, in experiment example 6, a rubber blade was used instead of the absorbing member and the elastic member.

A cleaning liquid applying mechanism where the cleaning liquid holding surface was arranged to be parallel with the nozzle forming surface was used. In addition, the cleaning liquid applying operation moves the nozzle forming surface and the cleaning liquid holding surface such that the relative moving speed in 4 cm/s while the cleaning liquid comes into contact with the nozzle forming surface, and brings the nozzle forming surface and the cleaning liquid holding surface into contact for 5 seconds.

The driving mechanism was a mechanism which performed a wiping operation which removed the ink composition which was attached to the nozzle forming surface using the absorbing member by bringing the absorbing member into contact with the nozzle forming surface by pressing the absorbing member with a predetermined load via a pressing member from the opposite side to the side which comes into contact with the nozzle forming surface of the recording heads and relatively moving the absorbing member and the recording heads.

2.4. Evaluation Test 2.4.1. Cleaning Property Test

Figure 10:
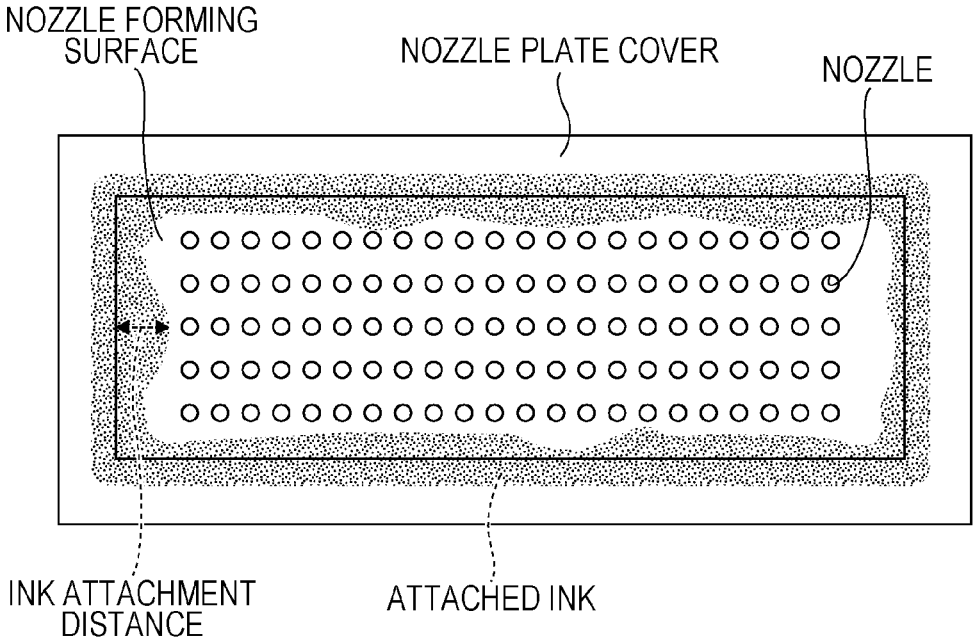
FIG. 10 is a diagram which schematically shows a nozzle forming surface to be used in experiment examples.

After performing a 20 minute recording operation using the ink compositions Bk 1, Bk 2, C, M, Y, and W shown in Table 1 using the modified PX-H10000, the cleaning liquid applying operation and the wiping operation were performed as in Table 3. With this as one cycle, the cycle was repeated 50 times. After that, the degree of ink attachment growth on the nozzle forming surface was observed with the naked eye and the ink attachment distance from the nozzle plate was measured. A reference drawing which shows the degree of ink attachment growth is shown in FIG. 10. Here, the heating temperature (the surface temperature of the recording surface of the recording medium) of the recording medium during the recording was 53° C. In addition, the heating of the recording medium was not performed during the recording operation using Bk 2.

A: the ink attachment amount (the ink attachment distance) was less than 0.1 mm

B: the ink attachment amount (the ink attachment distance) was 0.1 mm or more to 0.2 mm or less C: the ink attachment amount (the ink attachment distance) was more than 0.2 mm to 0.4 mm or less D: the ink attachment amount (the ink attachment distance) was more than 0.4 mm 2.4.2. Liquid Repelling Film Storability Test After performing a suction operation and performing a recording operation using the modified PX-H10000, the cleaning liquid applying operation and the wiping operation were performed as in Table 3. With this cycle as one time, the cycle was repeated 200 times. After that, the state of the liquid repelling film in the vicinity of the nozzles was measured with an optical microscope (a high precision non-contact height/depth measuring device "Hisomet II DH2" by Union Optical Co., Ltd.). Here, the heating temperature (the surface temperature of the recording surface of the recording medium) of the recording medium during the recording was 53° C. In addition, the heating of the recording medium was not performed during the recording operation using Bk 2.

A: a level where peeling of the liquid repelling film was not observed

B: a level where there was slight peeling and discoloration of the liquid repelling film, but the discharging was not affected C: a level where the liquid repelling film at the nozzle edges was peeled and the discharging was affected D: a level where the liquid repelling film of the entire nozzle surface was peeled and the discharging was greatly affected.

TABLE 3

| | Example 1 | Example 2 | Example 3 | Example 4 | Example 5 | Example 6 |
|---|---|---|---|---|---|---|
| Load on absorbing member (gf/cm) | 50 | 25 | 30 | 3.5 | 50 | |
| Wiping speed (cm/s) | 5 | 5 | 1 | 5 | 5 | 5 |
| Cleaning liquid applying operation | Yes | Yes | Yes | Yes | No | Yes |
| Cleaning member | Fabric | Fabric | Fabric | Fabric | Fabric | Rubber blade |

2.5. Evaluation Results

The above evaluation results are shown in Table 4.

TABLE 4

| | Example 1 | Example 2 | Example 3 | Example 4 | Example 5 | Example 6 |
|---|---|---|---|---|---|---|
| Cleaning property (Bk1) | A | B | A | C | B | D |
| Cleaning property (C) | A | B | A | C | B | D |
| Cleaning property (M) | A | B | A | C | B | D |
| Cleaning property (Y) | A | B | A | C | B | D |
| Cleaning property (W) | A | B | A | C | B | D |
| Cleaning property (Bk2) | A | B | A | C | B | D |
| Liquid repelling film storability (Bk1) | B | A | C | A | C | A |
| Liquid repelling film storability (C) | A | A | A | A | A | A |
| Liquid repelling film storability (M) | A | A | A | A | A | A |
| Liquid repelling film storability (Y) | A | A | A | A | A | A |
| Liquid repelling film storability (W) | B | A | C | A | C | A |
| Liquid repelling film storability (Bk2) | B | B | C | A | C | A |

From the evaluation results, it is clear that the cleaning property of the nozzle forming surface was deteriorated when the load was excessively weak (experiment example 4). In a case where inorganic pigments were used, it is clear that the storability of the liquid repelling film was deteriorated when the wiping speed was excessively slow (experiment example 3). In a case where inorganic pigments were used, it is clear that when the cleaning liquid applying operation was not carried out, the liquid repelling film storability was deteriorated (experiment example 5). With the rubber blade, it is clear that the cleaning property of the nozzle forming surface was remarkably deteriorated (experiment example 6).

The invention is not limited to the embodiments described above and various modifications are possible. For example, the invention includes configurations which are substantially the same as the configurations which were described in the embodiments (for example, a configuration where the function, the method, and the results are the same or a configuration where the object and the effects are the same). In addition, the invention includes configurations where non-essential portions of the configurations which were described in the embodiments are replaced. In addition, the invention includes configurations where the same operational effects are exhibited and configurations where it is possible to achieve the same object as the configurations which were described in the embodiments. In addition, the invention includes configurations where known techniques are added to the configurations which were described in the embodiments.

What is claimed is:

1. An ink jet recording apparatus comprising:

a recording head provided with a nozzle forming surface provided with nozzles which discharge an ink composition containing inorganic pigments, and a liquid repelling film which is provided on the nozzle forming surface, the liquid repelling film being monomolecular, having a thickness of 1 nm or more and 30 nm or less, and including a metal alkoxide;

a maintenance unit for preserving the recording head; and a movement section which is arranged at a position which faces the nozzle forming surface and the maintenance unit and which relatively moves the nozzle forming surface and the maintenance unit, wherein the maintenance unit has a cleaning liquid applying unit which applies a cleaning liquid to the nozzle forming surface, an absorbing member which absorbs attachments which are attached to the nozzle forming surface, a wiping unit which presses the absorbing member and the recording head with a load of 8 gf/cm or more to 150 gf/cm or less, the wiping unit having a driving mechanism which wipes off attachments on the nozzle forming surface by relatively moving the absorbing member with respect to the nozzle forming surface, a first capping section which covers the nozzle forming surface and which is provided with a suction mechanism which suctions the ink composition which is present on the nozzles, and a second capping section which forms a closed space by coming into contact with the nozzle forming surface.

2. The ink jet recording apparatus according to claim 1, wherein cleaning liquid applying unit has a cleaning liquid supply port which supplies the cleaning liquid to the nozzle forming surface, and the cleaning liquid forms a liquid film on the nozzle forming surface.

3. The ink jet recording apparatus according to claim 1, further comprising:

a control unit which controls the maintenance unit, wherein the control unit performs, in the following order, a cleaning liquid applying operation to apply the cleaning liquid to the nozzle forming surface, a wiping off operation to wipe off attachments on the nozzle forming surface with the absorbing member while pressing the absorbing member to the nozzle forming surface, and a moisturizing operation to moisturize the nozzle forming surface with the second capping section.

4. The ink jet recording apparatus according to claim 1, wherein the cleaning liquid applying unit, the absorbing member, and the second capping section are arranged to be lined up in order along the relative moving direction according to the movement section.

5. The ink jet recording apparatus according to claim 1, wherein the cleaning liquid applying unit and the second capping section are arranged to be lined up along the relative moving direction according to the movement section.

6. The ink jet recording apparatus according to claim 5, wherein the nozzle forming surface, the cleaning liquid applying unit, and the second capping section are provided to be inclined with respect to a horizontal plane.

7. The ink jet recording apparatus according to claim 6, wherein the cleaning liquid supply port is arranged at a position which is higher than the second capping section.

8. The ink jet recording apparatus according to claim 1, wherein the absorbing member and the first capping section are arranged to be lined up along the relative moving direction according to the movement section.

9. The ink jet recording apparatus according to claim 1, wherein a surface tension of the cleaning liquid is 20 mN/m or more and 45 mN/m or less.

10. The ink jet recording apparatus according to claim 1, wherein the liquid repelling film formed on a conductive film that is formed on the nozzle forming surface.

11. The ink jet recording apparatus according to claim 1, further comprising:

at least a second recording head provided with a nozzle forming surface provided with nozzles which discharge an ink composition containing inorganic pigments;

wherein the first capping section includes at least a first and a second cap member configured to cover each of the recording heads.

12. The ink jet recording apparatus according to claim 11, wherein the second capping section is configured to cover the recording heads as a batch.

13. The ink jet recording apparatus according to claim 1, wherein second capping section includes a moisturizing liquid to preserve humidity within the closed space.

14. The ink jet recording apparatus according to claim 1, wherein the cleaning liquid applying unit, the wiping unit, the first capping section, and the second capping section are positioned along a line; and wherein the cleaning liquid applying unit and the wiping unit are positioned between the first capping section and the second capping section.

15. An ink jet recording apparatus comprising:

a recording head provided with a nozzle forming surface provided with nozzles which discharge an ink composition containing inorganic pigments, and a liquid repelling film which is provided on the nozzle forming surface, the liquid repelling film being monomolecular, having a thickness of 1 nm or more and 30 nm or less, and including a metal alkoxide;

a maintenance unit for preserving the recording head; and a movement section which is arranged at a position which faces the nozzle forming surface and the maintenance unit and which relatively moves the nozzle forming surface and the maintenance unit, wherein the maintenance unit has a cleaner configured to apply a cleaning liquid to the nozzle forming surface, an absorber configured to absorb attachments which are attached to the nozzle forming surface, a wiper configured to press the absorber and the recording head with a load of 8 gf/cm or more to 150 gf/cm or less, the wiper having a driver configured to wipe off attachments on the nozzle forming surface by relatively moving the absorber with respect to the nozzle forming surface, a first cap configured to cover the nozzle forming surface and suction the ink composition which is present on the nozzles, and a second cap configured to form a closed space by coming into contact with the nozzle forming surface.

16. The ink jet recording apparatus according to claim 15, further comprising:

at least a second recording head provided with a nozzle forming surface provided with nozzles which discharge an ink composition containing inorganic pigments;

wherein the first cap includes a plurality of caps that are each configured to cover one of the recording heads.

17. The ink jet recording apparatus according to claim 16, wherein the second cap is further configured to cover the recording heads as a batch.

18. The ink jet recording apparatus according to claim 15, wherein the second cap includes a moisturizing liquid to preserve humidity within the closed space.

19. The ink jet recording apparatus according to claim 15, wherein the cleaner, the wiper, the first cap, and the second cap are positioned along a line; and wherein the cleaner and the wiper are positioned between the first cap and the second cap.

* * * * *